US011691258B2

(12) United States Patent
Ishikawa

(10) Patent No.: US 11,691,258 B2
(45) Date of Patent: Jul. 4, 2023

(54) DRIVING TOOL

(71) Applicant: MAKITA CORPORATION, Anjo (JP)

(72) Inventor: Naoharu Ishikawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 181 days.

(21) Appl. No.: 17/411,767

(22) Filed: Aug. 25, 2021

(65) Prior Publication Data

US 2022/0126429 A1 Apr. 28, 2022

(30) Foreign Application Priority Data

Oct. 26, 2020 (JP) ..... 2020-178693

(51) Int. Cl.
*B25C 1/00* (2006.01)
*B25C 1/04* (2006.01)

(52) U.S. Cl.
CPC ..... *B25C 1/008* (2013.01); *B25C 1/047* (2013.01)

(58) Field of Classification Search
CPC ..... B25C 1/00; B25C 1/008
See application file for complete search history.

(56) References Cited

U.S. PATENT DOCUMENTS 5,732,870 A 3/1998 Moorman et al.
5,772,096 A 6/1998 Osuka et al.
6,796,475 B2 * 9/2004 Adams ..... H02P 3/08 227/129
6,974,061 B2 * 12/2005 Adams ..... H02P 3/08 227/2
7,469,811 B2 * 12/2008 Shima ..... B25C 1/06 227/2
7,494,036 B2 * 2/2009 Shima ..... B25C 1/06 227/8
7,905,377 B2 * 3/2011 Krondorfer ..... B25C 1/06 173/90
7,934,565 B2 * 5/2011 Krondorfer ..... B25C 1/06 227/129

(Continued)

FOREIGN PATENT DOCUMENTS

JP 3287172 B2 5/2002
JP 2018-144122 A 9/2018

*Primary Examiner* — Praachi M Pathak
(74) *Attorney, Agent, or Firm* — Oliff PLC

(57) ABSTRACT

A driving tool including a timer assembly less susceptible to heat operates at a stable operating speed. The driving tool includes a trigger, a contact arm, and a timer assembly that operates in response to the trigger moving to a trigger-on-position with the contact arm remaining at an arm-off-position. The timer assembly includes a flywheel rotatable in response to the trigger moving to the trigger-on-position, and a contact restrictor movable between an unlock position at which the contact restrictor allows the contact arm to move to an arm-on-position and a lock position at which the contact restrictor restricts the contact arm from moving to the arm-on-position. The contact restrictor takes a predetermined period to move from the unlock position to the lock position in response to the trigger moving to the trigger-on-position. The predetermined period is defined by an inertial force generated by rotation of the flywheel.

19 Claims, 20 Drawing Sheets

(56) References Cited

U.S. PATENT DOCUMENTS

| | | | | |
|---|---|---|---|---|
| 7,938,305 | B2 * | 5/2011 | Simonelli | B25C 1/06 227/129 |
| 8,136,606 | B2 * | 3/2012 | Krondorfer | B25C 1/06 173/1 |
| 8,162,073 | B2 * | 4/2012 | Krondorfer | B25C 1/06 173/1 |
| 8,167,182 | B2 * | 5/2012 | Shima | B25C 1/06 361/170 |
| 8,313,012 | B2 * | 11/2012 | Shima | B25C 1/06 227/129 |
| 8,505,798 | B2 * | 8/2013 | Simonelli | B25F 5/02 227/126 |
| 11,052,522 | B2 * | 7/2021 | Ishikawa | B25C 7/00 |
| 2014/0110450 | A1 | 4/2014 | Moore et al. | |
| 2014/0110452 | A1 | 4/2014 | Moore et al. | |
| 2019/0389045 | A1 | 12/2019 | Ishikawa et al. | |

* cited by examiner

DRIVING TOOL

CROSS-REFERENCE TO RELATED APPLICATIONS

This application claims the benefit of priority to Japanese Patent Application No. 2020-178693, filed on Oct. 26, 2020, the entire contents of which are hereby incorporated by reference.

BACKGROUND

1. Technical Field

The present disclosure relates to a driving tool such as a nailer.

2. Description of the Background

A nailer that is powered by compressed air may include a tool body performing a driving operation in response to a contact arm and a trigger of the nailer both turned on. The contact arm located at a distal end of a driving nose is turned on herein by pressing the contact arm against a workpiece and moving the contact arm upward relative to a nozzle. The trigger is turned on by pulling the trigger with a finger. Turning on either the contact arm or the trigger alone does not cause a driving operation. This structure can avoid performing an accidental driving operation.

This type of driving tool can perform various driving operations including a targeted driving operation and a swing driving operation. The targeted driving operation is performed by first pressing the contact arm against a workpiece to turn on the contact arm and then pulling the trigger. The swing driving operation is performed by turning on and off the contact arm by swinging the driving tool up and down while the trigger remains pulled. For the targeted driving operation, the trigger is to be turned off every time before another driving operation (single driving). For the swing driving operation, the contact arm is repeatedly turned on and off while the trigger remains pulled to continuously perform one driving operation after another (continuous driving).

The technique described in U.S. Pat. No. 5,732,870 (hereafter, Patent Literature 1) uses an electronically controlled solenoid valve to operate a head valve that opens and closes the supply path of compressed air to a driving drive. Driving tools described in U.S. Patent Application Publication No. 2014/0110450 (hereafter, Patent Literature 2) and U.S. Patent Application Publication No. 2014/0110452 (hereafter, Patent Literature 3) use an electronically controlled solenoid valve to switch between the continuous driving and the single driving. The electronically controlled solenoid valve (activating valve) allows appropriate control of driving operations including the single driving and the continuous driving.

The techniques described in Patent Literatures 1 to 3 use compressed air as part of power to move the stem of the activating valve. This structure takes time before turning on or off the activating valve, thus degrading the quick driving of the driving operations.

The technique for mode switching described in Japanese Patent No. 3287172 (hereafter, Patent Literature 4) uses a microswitch to separately detect an on-operation on the contact arm and an on-operation on the trigger, and uses a timer to measure the period that passes from the on-operation on the contact arm. This structure allows, in a single driving mode, a driving operation to be performed in response to the trigger turned on before a predetermined period passes from an on-operation on the contact arm. After one driving operation, turning off the trigger resets the state in which no continuous driving operations are allowed. In a continuous driving mode, resetting the timer and repeated driving operations are allowed in response to the contact arm turned on before a predetermined period passes from an on-operation on the trigger. When the contact arm is not turned on within the predetermined period measured with the timer, no succeeding on-operation is performed and thus no driving operation is allowed. No driving operation is also allowed by engaging a lock pin with the contact arm to lock the contact arm at the off-position. The above mode switching technique allows the driving tool to avoid an accidental driving operation when, for example, the contact arm accidentally comes in contact with an unintended portion while the driving tool is being carried with its grip held and the trigger remaining turned on in the continuous driving mode.

The technique described in Patent Literature 4 uses a manually operated activating valve. This structure does not degrade the quick driving. However, when the power supply to the microswitch or other components including a controller that operates in response to input signals from the microswitch stops or is disconnected due to a decrease in the remaining capacity of a battery, no driving operation is performed and the work is to be suspended. The same applies to the techniques described in Patent Literatures 1 to 3. Once the power supply stops, the activating valve does not operate, and no driving operation can be performed.

In contrast, a driving tool described in Japanese Unexamined Patent Application Publication No. 2018-144122 (hereafter, Patent Literature 5) uses a mechanical timer assembly to prevent an accidental on-operation on the contact arm. This allows a driving operation under no power supply.

BRIEF SUMMARY

However, the timer assembly described in Patent Literature 5 includes a rotary damper containing a silicone oil and may have an unstable operating speed under heat.

One or more aspects of the present disclosure are directed to a driving tool including a timer assembly less susceptible to heat to operate at a stable operating speed.

An aspect of the present disclosure provides a driving tool, including:

- a trigger movable between a trigger-on-position and a trigger-off-position;
- a contact arm movable between an arm-on-position and an arm-off-position; and
- a timer assembly configured to operate in response to the trigger moving to the trigger-on-position with the contact arm remaining at the arm-off-position, the timer assembly including
  - a flywheel rotatable in response to the trigger moving to the trigger-on-position, and
  - a contact restrictor movable between an unlock position at which the contact restrictor allows the contact arm to move to the arm-on-position and a lock position at which the contact restrictor restricts the contact arm from moving to the arm-on-position, the contact restrictor being configured to take a predetermined period to move from the unlock position to the lock position in response to the trigger moving to the trigger-on-position, the predetermined period being defined by an inertial force generated by rotation of the flywheel.

Thus, when the trigger is at the trigger-off-position, the contact restrictor is at the unlock position. With the contact restrictor at the unlock position, the contact arm is allowed to move to the arm-on-position. In response to the trigger moving to the trigger-on-position, the contact restrictor in the timer assembly moves from the unlock position to the lock position for a predetermined period. With the contact restrictor at the lock position, the contact arm is restricted from moving to the arm-on-position. This structure can avoid an accidental driving operation with a tool body. The predetermined period taken by the contact restrictor to move from the unlock position to the lock position is defined by an inertial force generated by rotation of the flywheel. This structure is unsusceptible to heat around a rotary damper containing a silicone oil that is used to set a predetermined period in a known structure, thus allowing the timer assembly to operate at a stable speed.

BRIEF DESCRIPTION OF DRAWINGS

FIG. 17 is a perspective view of the timer assembly as viewed diagonally from the lower right with the trigger turned off and the contact arm turned on.

FIG. 18 is a perspective view of the timer assembly as viewed diagonally from the lower right with the trigger turned on and the contact arm turned on.

FIG. 19 is a perspective view of the timer assembly as viewed diagonally from the upper left with the trigger turned on and the contact arm locked from being turned on.

FIG. 20 is a perspective view of the timer assembly as viewed diagonally from the lower right with the trigger turned on and the contact arm locked from being turned on.

DETAILED DESCRIPTION

Figure 1:
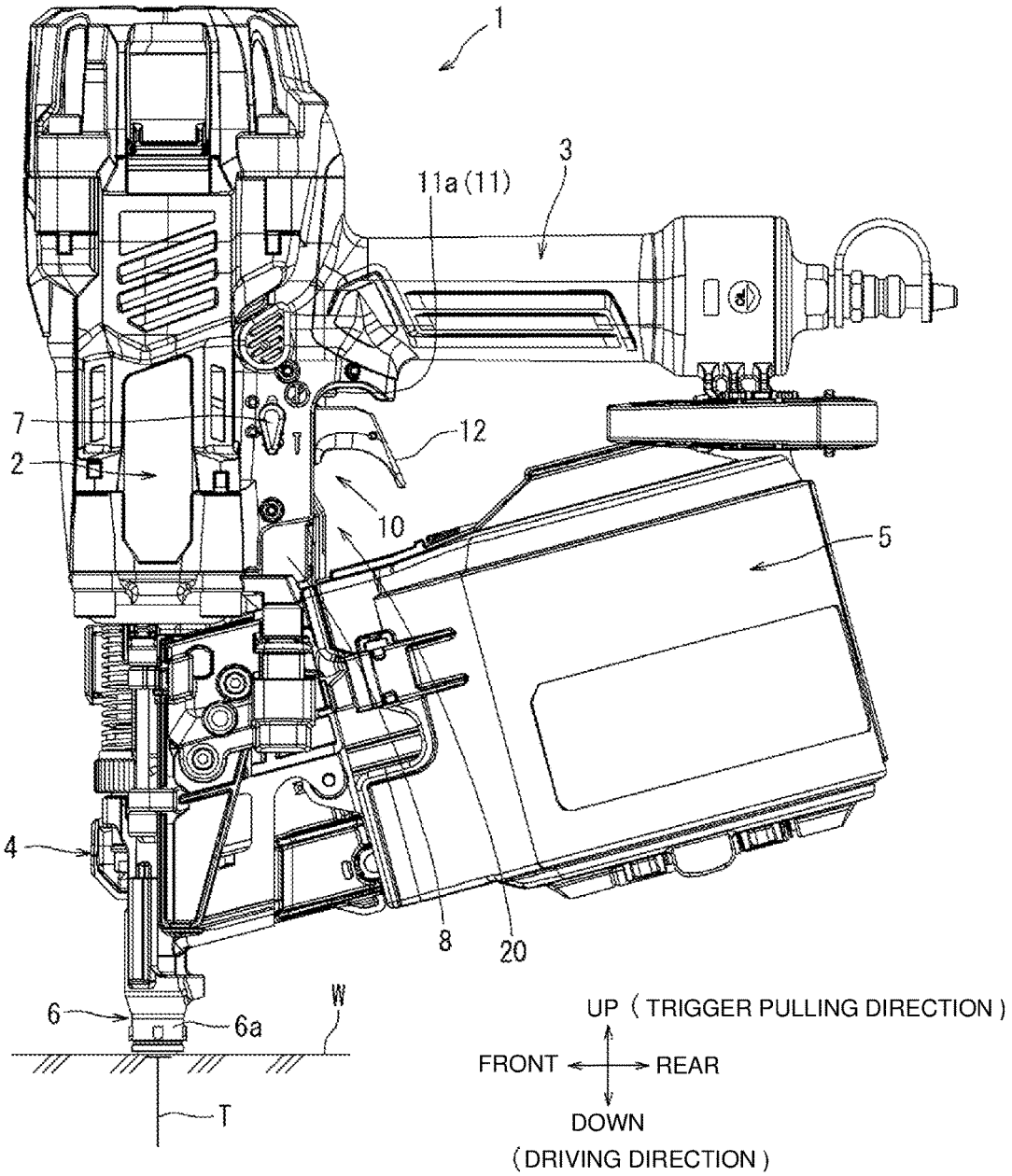
FIG. 1 is a left side view of a driving tool.
Figure 2:
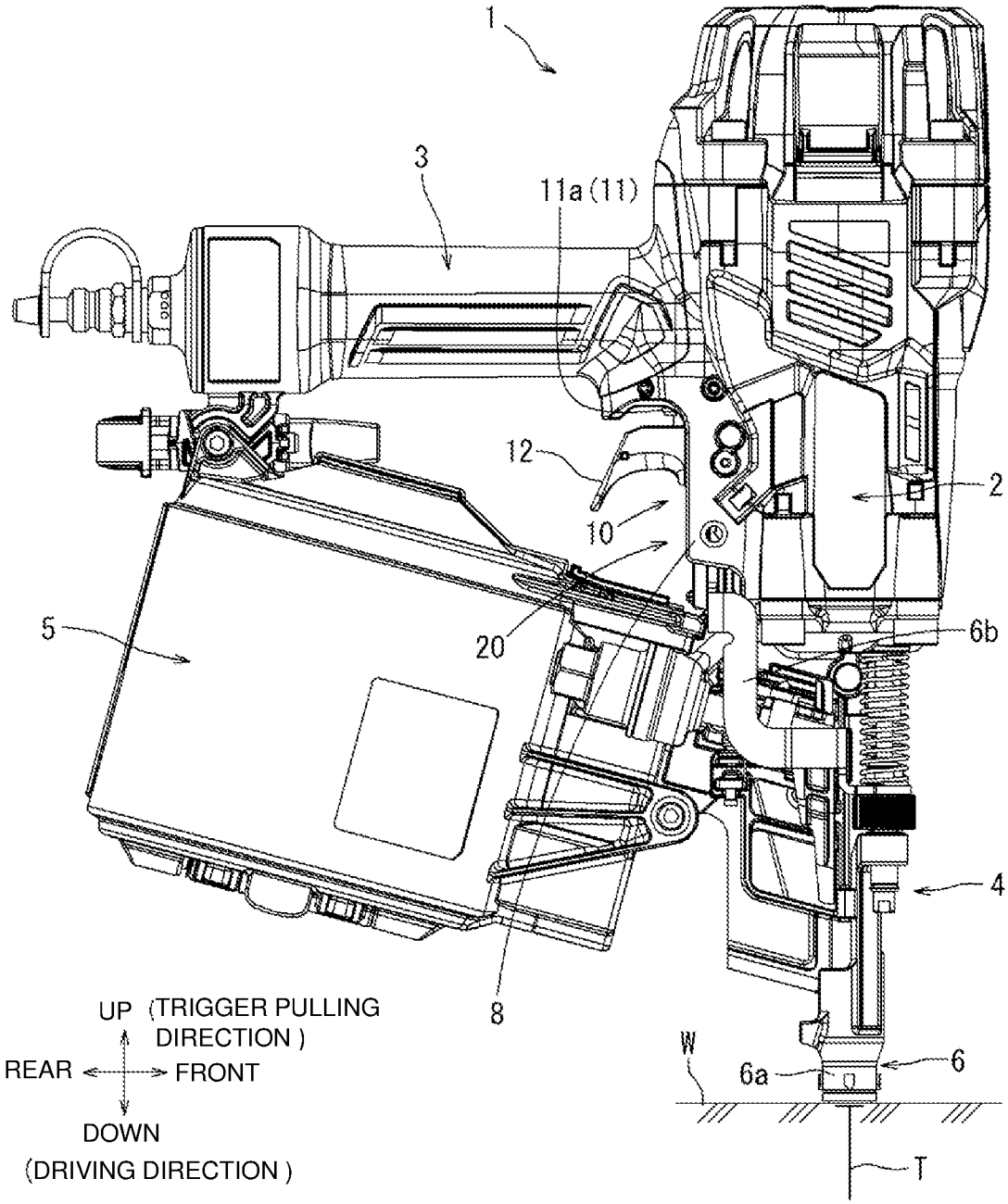
FIG. 2 is a right side view of the driving tool.
Figure 3:
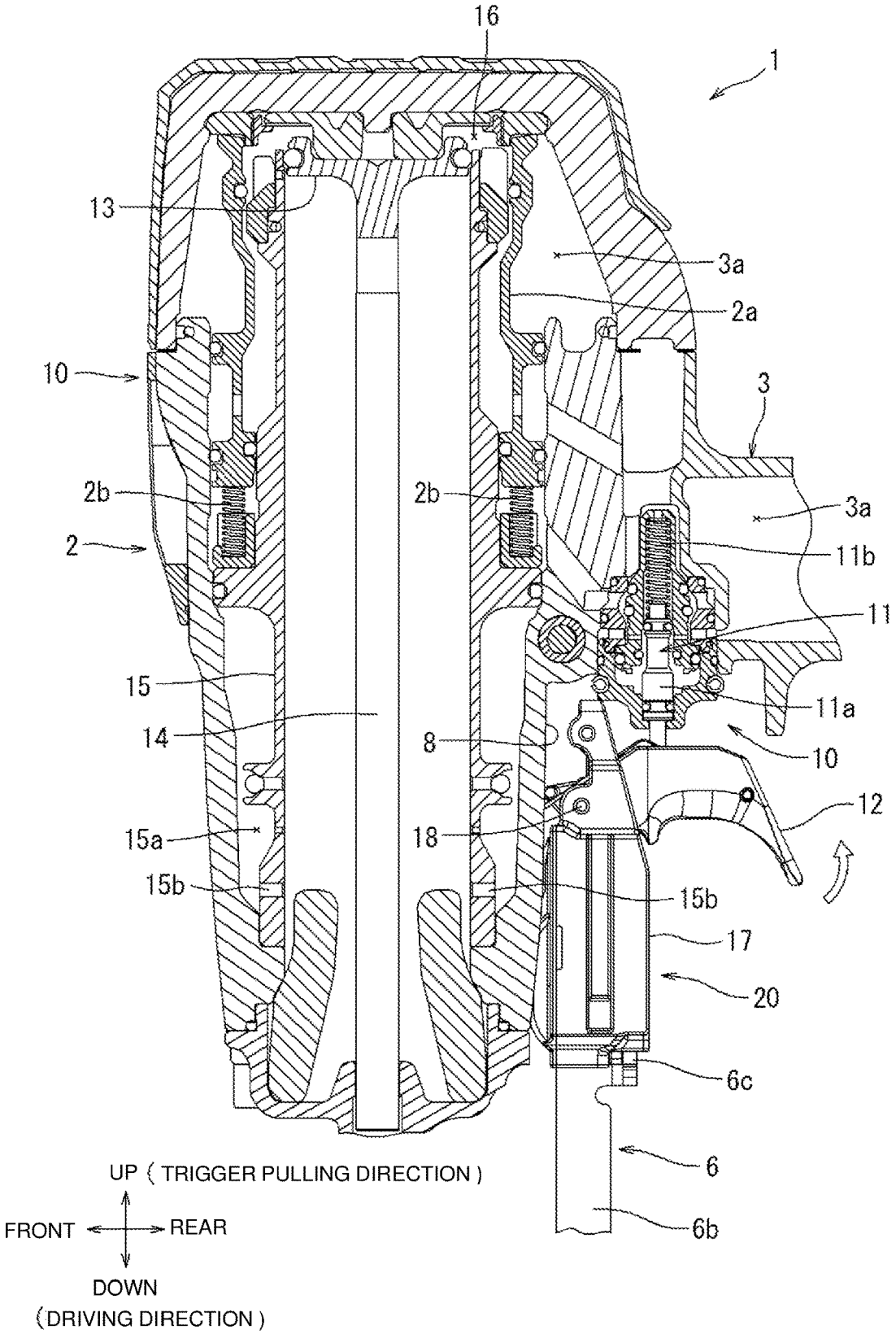
FIG. 3 is a longitudinal sectional view of a tool body.
Figure 4:
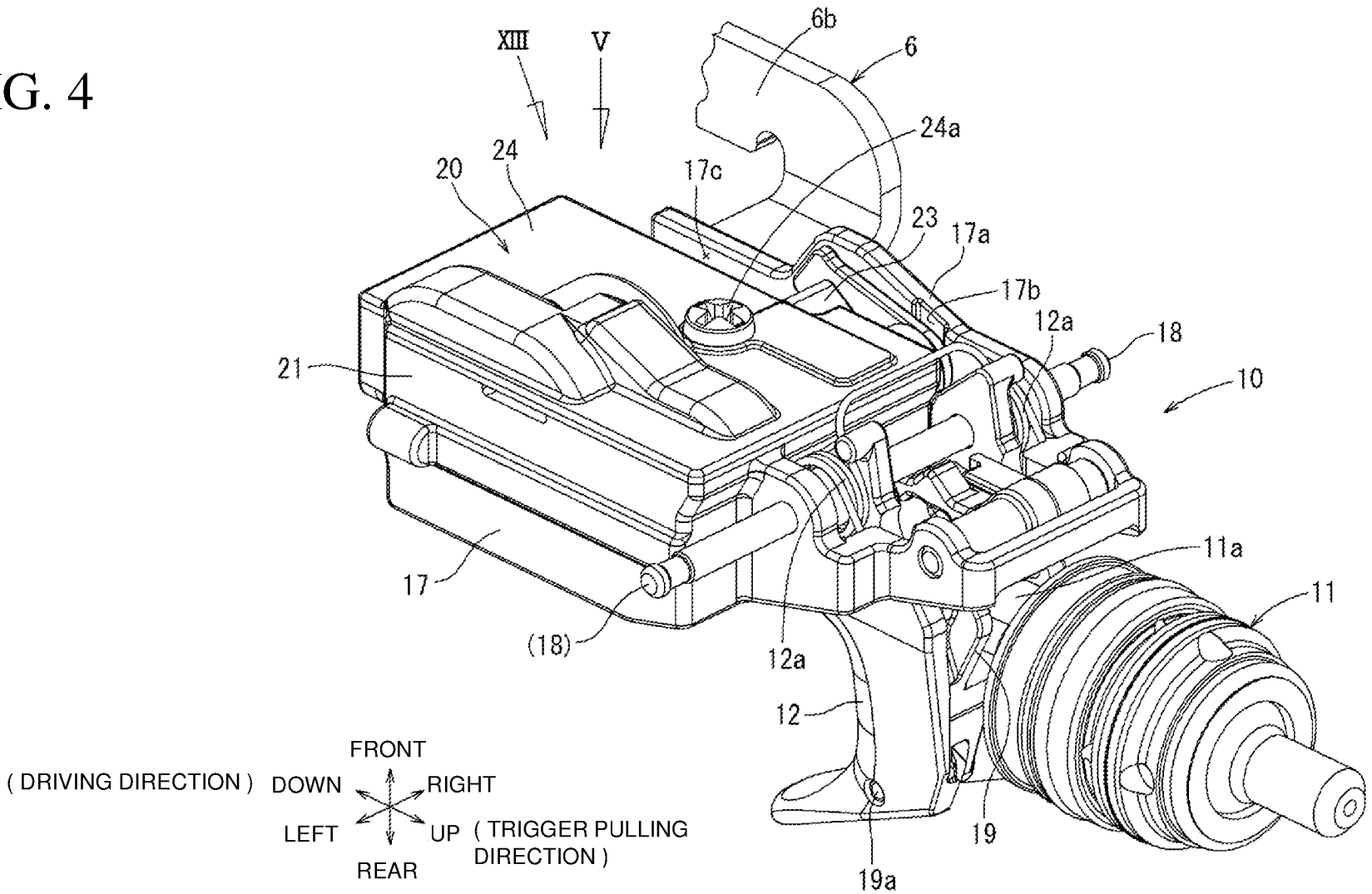
FIG. 4 is a perspective view of a timer assembly.
Figure 5:
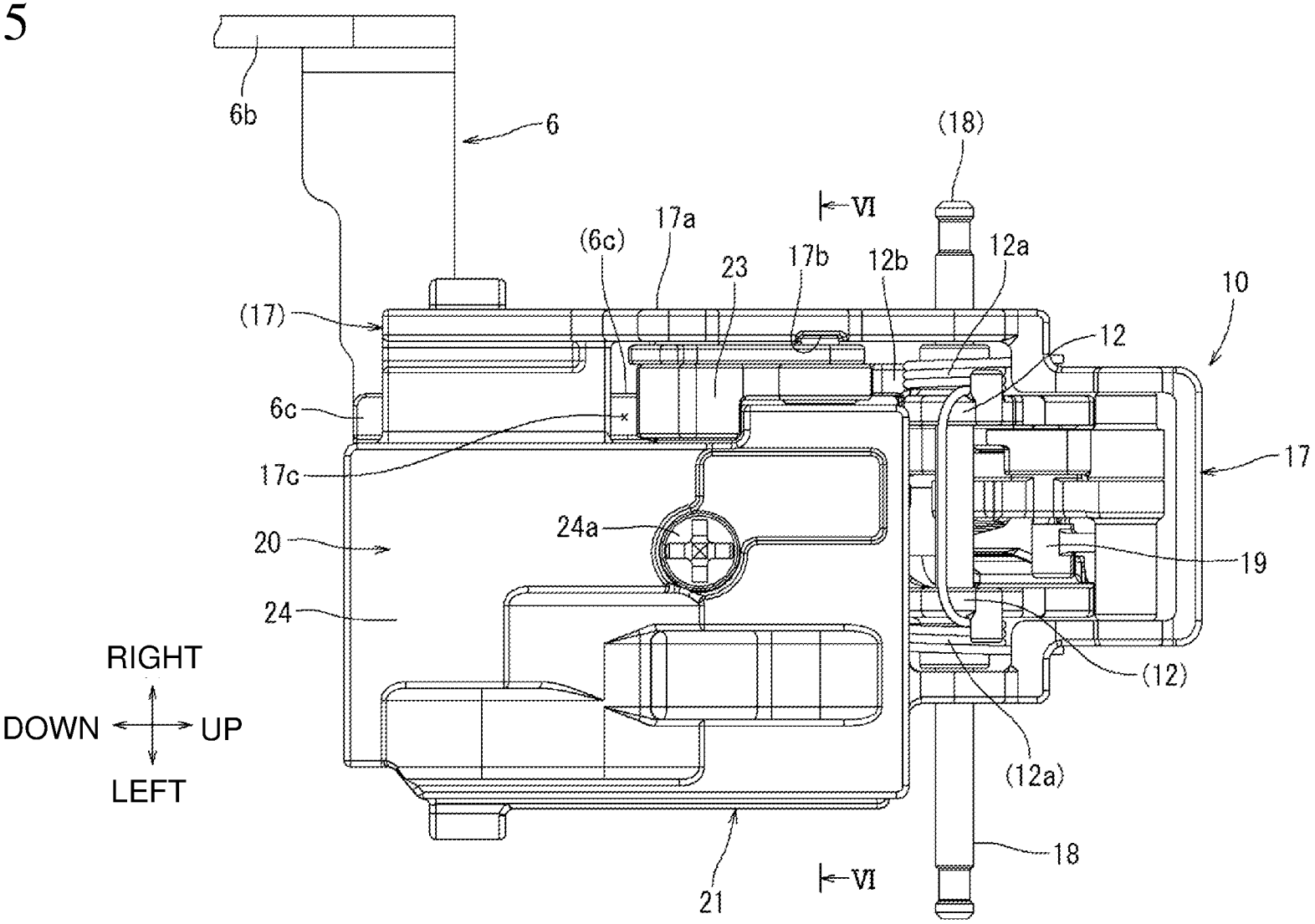
FIG. 5 is a front view of the timer assembly as viewed in the direction indicated by arrow V in FIG. 4.

Embodiments of the present disclosure will now be described with reference to FIGS. 1 to 20. As shown in FIGS. 1 to 3, a driving tool 1 according to the present embodiment is a pneumatic nailer. The driving tool 1 includes a tool body 2, a grip 3, a driving nose 4, and a magazine 5.

The tool body 2 accommodates a cylinder 15 and a piston 13. The piston 13, which is powered by compressed air, vertically reciprocates in the cylinder 15. The grip 3 protrudes laterally from one side of the tool body 2. The driving nose 4 is located below the tool body 2. The driving nose 4 extends downward (in the direction in which a fastener T is driven). The magazine 5 extends between the driving nose 4 and the grip 3, and is loadable with many fasteners.

Hereafter, the driving direction in which the fastener T is driven is downward, and the direction opposite to the driving direction is upward. A user of the driving tool 1 is rearward from the driving tool 1 and holds the grip 3. The direction toward the user is rearward, and the opposite direction is frontward. The right-left direction is also defined as viewed from the user.

The driving nose 4 supports, on its distal end, a contact arm 6 in a manner relatively movable vertically. A driving operation can be performed in response to the contact arm 6 pressed against a workpiece W and relatively moving upward. The contact arm 6 extends from around the distal end of the driving nose 4 toward a trigger 12. The contact arm 6 has, in its lower portion, a contact portion 6*a*. The contact portion 6*a* is annular, and is located around the distal end of the driving nose 4, or a nozzle.

As shown in FIG. 2, a strip-like extension 6*b* is connected to the contact portion 6*a*. The extension 6*b* extends upward. As shown in FIG. 3, an actuating member 6*c* is located in an upper portion of the extension 6*b*. The actuating member 6*c* extends to below the trigger 12. The contact arm 6 integrally includes the contact portion 6*a*, the extension 6*b*, and the actuating member 6*c*. The contact arm 6 is supported in a manner vertically movable along the driving nose 4 within a predetermined range.

An activating system 10 in the present embodiment is located near the base of the grip 3 and on a side portion of the tool body 2. An activation operation of the activating system 10 turns on an activating valve 11. This causes compressed air to be fed into a piston upper chamber 16 in the tool body 2. The piston 13 then moves downward in the cylinder 15 to cause a driving operation.

An elongated rod impact driver 14 is attached to the lower surface of the piston 13. The impact driver 14 moves downward in the driving nose 4 (driving path) as the piston 13 moves downward. This causes one fastener T to be ejected through the distal end (nozzle) of the driving nose 4. One fastener T at a time is fed from the magazine 5 into the driving nose 4 in cooperation with the driving operation.

As shown in FIG. 1, a trigger lock lever 7 is located on a side portion of the activating system 10. With the trigger lock lever 7 rotated downward as shown in FIG. 1, the trigger 12 can be pulled upward. With the trigger lock lever 7 rotated counterclockwise (upward) by about 90° in FIG. 1, the trigger is locked. When locked, the trigger 12 cannot be pulled upward. The trigger lock lever 7 is turned upward to a lock position to avoid the trigger 12 being unintentionally pulled. This prevents an accidental driving operation of the driving tool 1.

The activating system 10 in the present embodiment has an aspect unseen in known structures. The basic structure of the driving tool 1 is the same in the present embodiment and will not be described in detail.

The activating system 10 turns on the activating valve 11 in response to the trigger 12 and the contact arm 6 both turned on. The activating system 10 in the present embodiment includes the activating valve 11 described above, the trigger 12, and a timer assembly 20. As shown in FIG. 3, the activating valve 11 is accommodated in the lower surface of the grip 3 adjacent to its base. A valve stem 11*a* includes a lower portion protruding toward the trigger 12. The valve stem 11*a* is supported in a manner vertically movable (between an on-position and an off-position). The valve stem 11*a* is urged by a compression spring 11*b* in the direction in which the valve stem 11*a* moves downward to the off-position. In FIG. 3, the valve stem 11*a* is at the off-position. The valve stem 11*a* moves upward from the off-position against the urging force from the compression spring 11*b* to turn on the activating valve 11.

The activating valve 11 is turned on to cause downward air pressure to move a head valve 2*a* downward and thus open the head valve 2*a*. This causes compressed air accumulating in an accumulator 3*a* in the grip 3 to be fed into the piston upper chamber 16. The valve stem 11*a* returns downward under the urging force from the spring to turn off the activating valve 11. This causes upward air pressure and an urging force from a compression spring 2*b* to move the head valve 2*a* upward. This closes the piston upper chamber 16 against the accumulator 3*a*. Upon being closed, the piston upper chamber 16 releases air to the atmosphere. The compressed air flowing into a return air chamber 15*a* passes through air vents 15*b* to act on the lower surface of the lowered piston 13. The compressed air acting on the lower surface returns the lowered piston 13 to the top dead center (initial position).

To start the driving operation described above (to move the valve stem 11*a* to the on-position), the trigger 12 is to move to a trigger-on-position and the contact arm 6 is to move to an arm-on-position. The contact arm 6 is first turned on, and then the trigger 12 is turned on to cause a single driving operation (targeted driving operation). A driving operation can also be performed when the trigger 12 is first turned on with the contact arm 6 remaining at an arm-off position, and then the contact arm 6 is turned on within a predetermined period. The on-operation on the contact arm 6 is repeated within a predetermined period with the trigger 12 remaining turned on to cause continuous driving operations (swing driving operations). For the trigger 12 turned on first, a predetermined period t from an on-operation on the trigger 12 to when the on-operation on the contact arm 6 is locked is set by the timer assembly 20 described below.

FIGS. 4 to 7 show the activating system 10 in detail. The activating system 10 is supported on a base 8 on the rear face of the tool body 2. The activating system 10 includes an activating base 17, the trigger 12, and the timer assembly 20. The trigger 12 and the timer assembly 20 are supported on the activating base 17. The activating base 17 is connected to the base 8.

Figure 7:
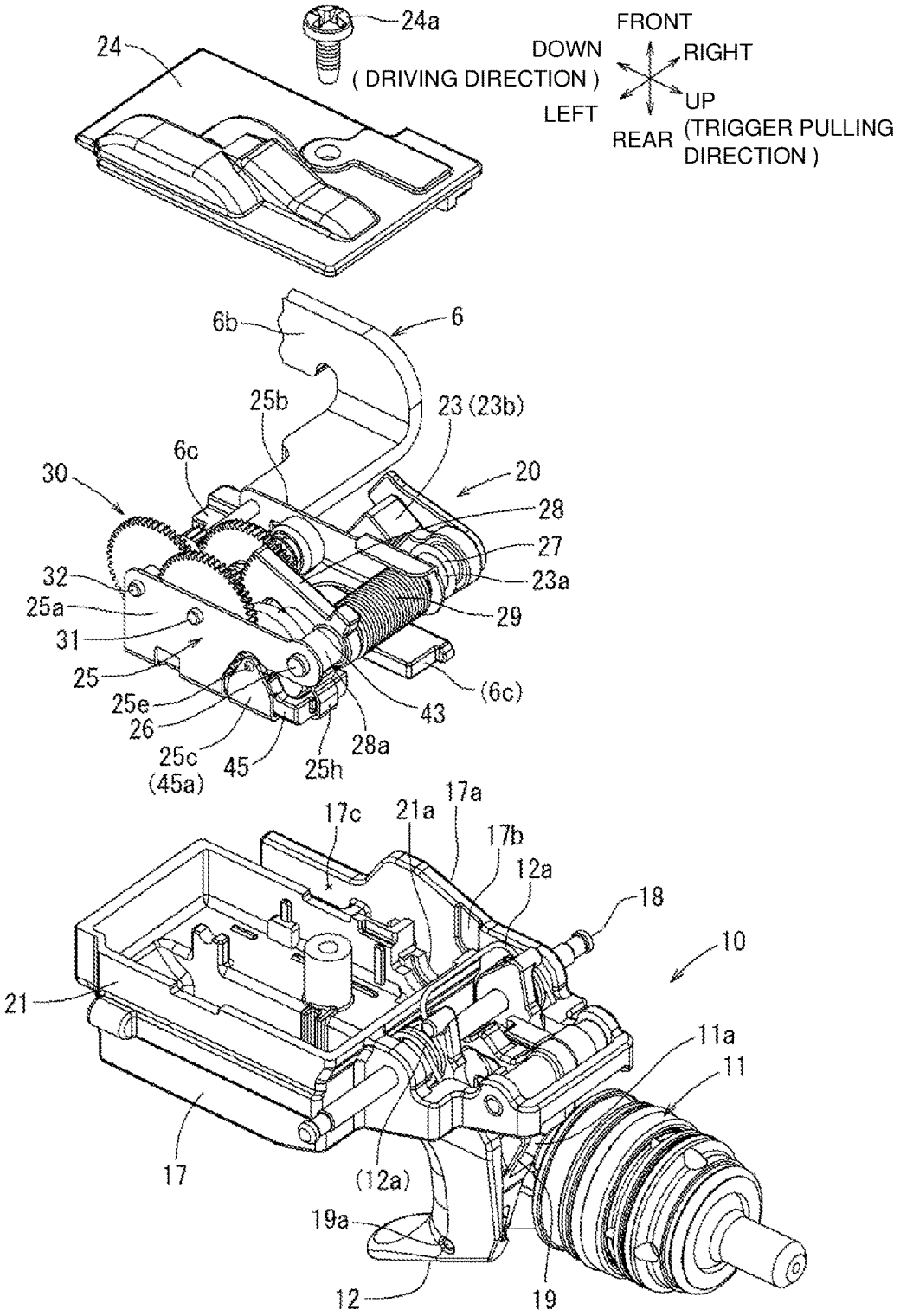
FIG. 7 is an exploded perspective view of the timer assembly.
Figure 13:
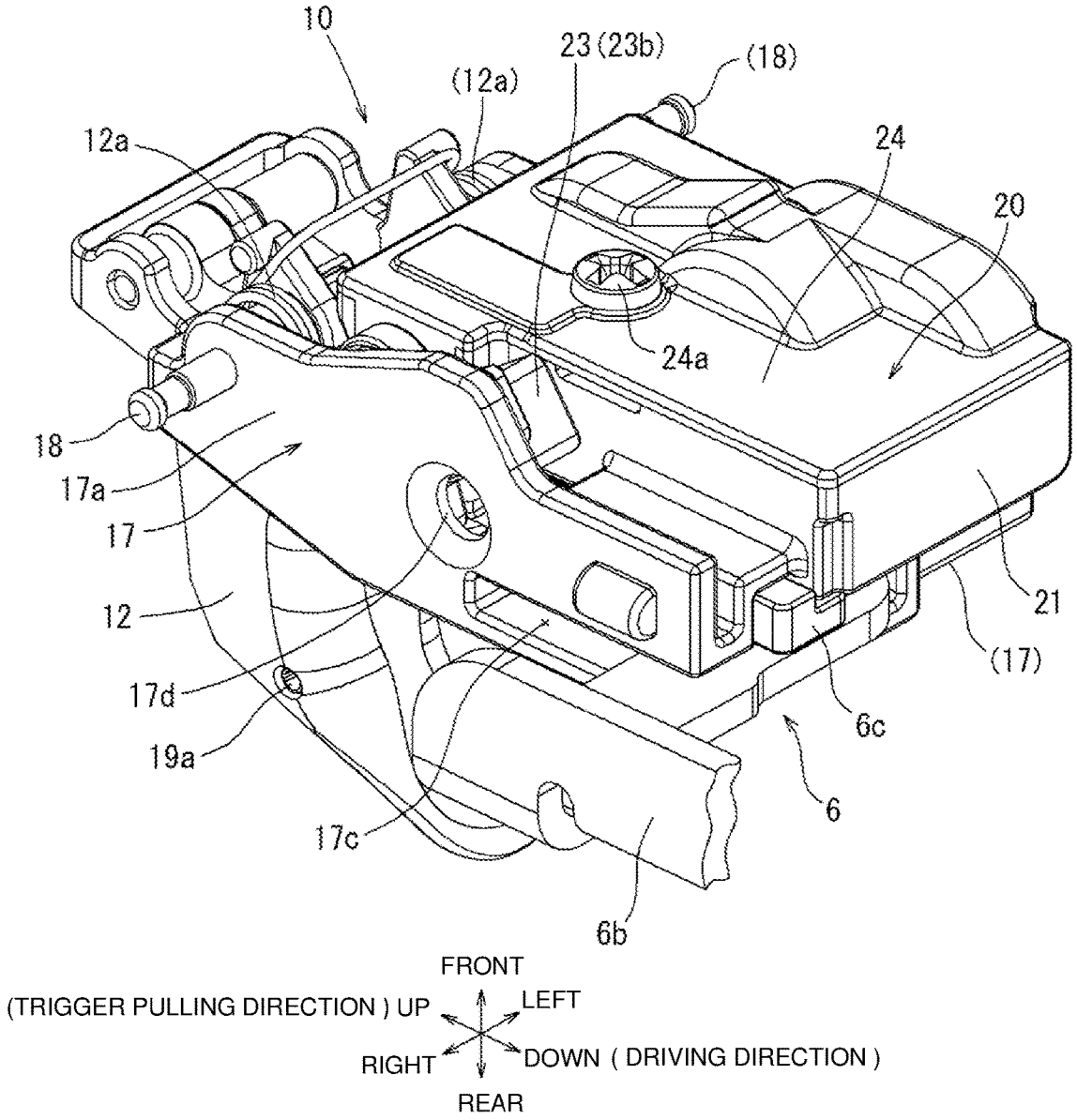
FIG. 13 is a perspective view of the timer assembly as viewed in the direction indicated by arrow XIII in FIG. 4 and diagonally from the lower right with the contact restrictor at the unlock position being visually unobservable through a window.
Figure 14:
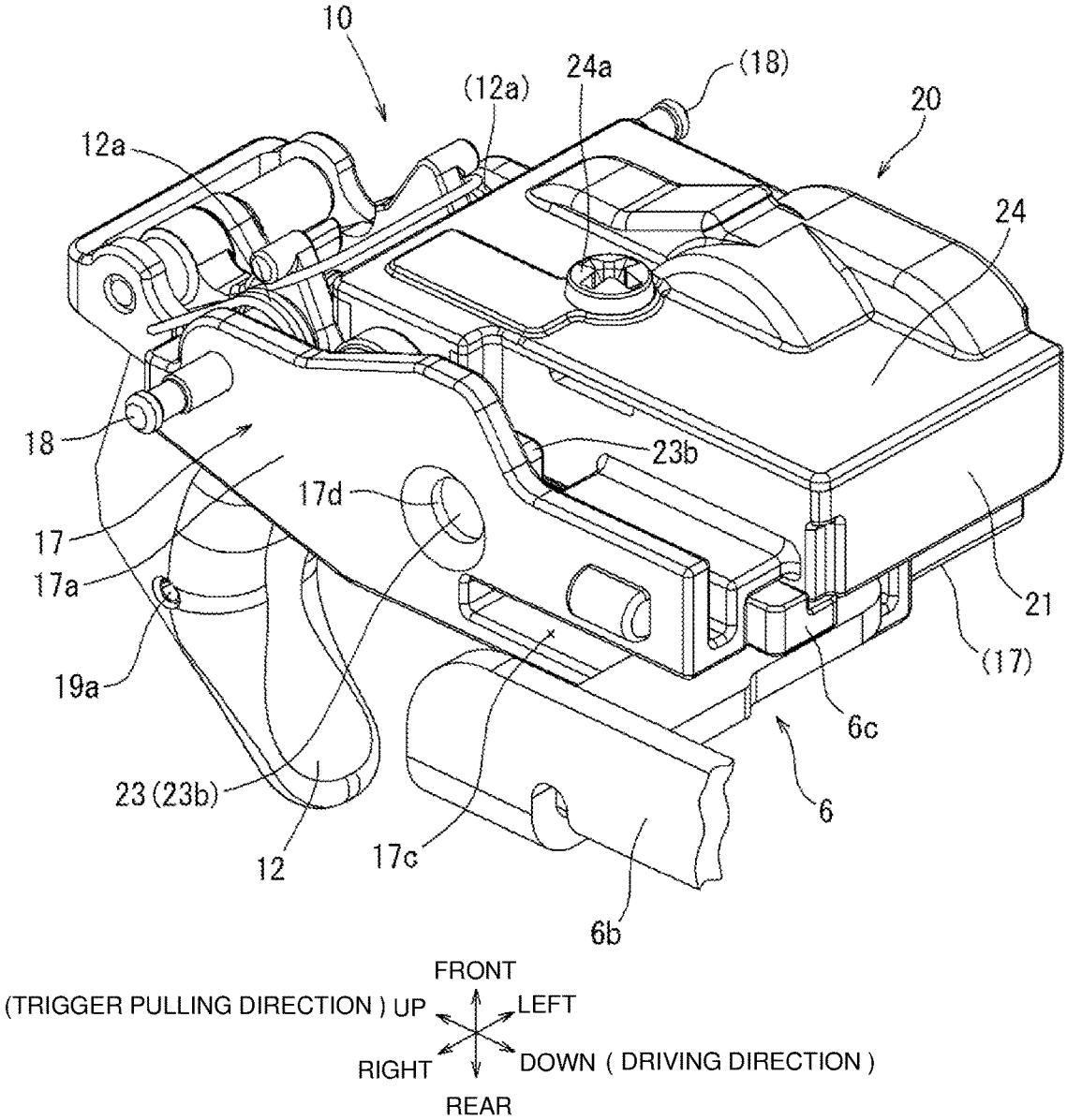
FIG. 14 is a perspective view of the timer assembly as viewed diagonally from the lower right with the contact restrictor at a lock position being visually observable through the window.

As shown in FIGS. 7, 13, and 14, the activating base 17 includes a shielding wall 17*a* on its right side surface. The shielding wall 17*a* shields a contact restrictor 23 from other components. The shielding wall 17*a* prevents the contact restrictor 23 from coming in contact with other components. This structure allows the timer assembly 20 to avoid malfunctioning. The shielding wall 17*a* also protects the contact restrictor 23 from dust. This structure also allows the contact restrictor 23 to avoid malfunctioning.

The activating base 17 has a guide groove 17*c* along the shielding wall 17*a*. The guide groove 17*c* mainly guides the actuating member 6*c* in the contact arm 6 vertically. The actuating member 6*c* moves upward in the guide groove 17*c* to turn on the contact arm 6.

The trigger 12 is supported on an upper portion of the activating base 17. The trigger 12 is supported about a support shaft 18 in a manner vertically rotatable. The trigger 12 is pulled upward by a finger of a hand holding the grip 3. The position at which the trigger 12 is pulled upward to turn on the activating valve 11 corresponds to an on-position of the trigger 12 (trigger-on-position). The trigger 12 is urged by a torsion spring 12*a* in the direction in which the trigger 12 rotates downward toward an off-position (trigger-off-position).

An idler 19 is supported on the back surface (upper surface) of the trigger 12 in a manner vertically rotatable about a support shaft 19*a*. The idler 19 is urged by a torsion spring (not shown) placed around the support shaft 19*a* in the direction in which the rotation distal end (front) of the idler 19 moves upward. Under the urging force from the torsion spring, the idler 19 is constantly pressed against the distal end of the valve stem 11*a*.

When the trigger 12 is pulled upward (to the trigger-on-position) and the contact arm 6 moves upward and is turned on (to the arm-on-position), the actuating member 6*c* presses the rotation distal end of the idler 19 upward, restricting the rotation distal end from moving downward. The valve stem 11*a* is thus pressed upward to turn on the activating valve 11. The position at which the contact arm 6 turns on the activating valve 11 corresponds to the arm-on-position of the contact arm 6. When the trigger 12 is not pulled after the contact arm 6 moves to the arm-on-position and is turned on, a portion of the idler 19 around the support shaft 19*a* remains unmoved and the activating valve 11 is thus not turned on. The trigger 12 is then pulled to turn on the activating valve 11, causing a single driving operation. When the contact arm 6 is not turned on after the trigger 12 is pulled, the rotation distal end of the idler 19 remains unpressed upward and the activating valve 11 is thus not turned on. The contact arm 6 is then turned on within a predetermined period to turn on the activating valve 11, causing a driving operation.

Figure 16:
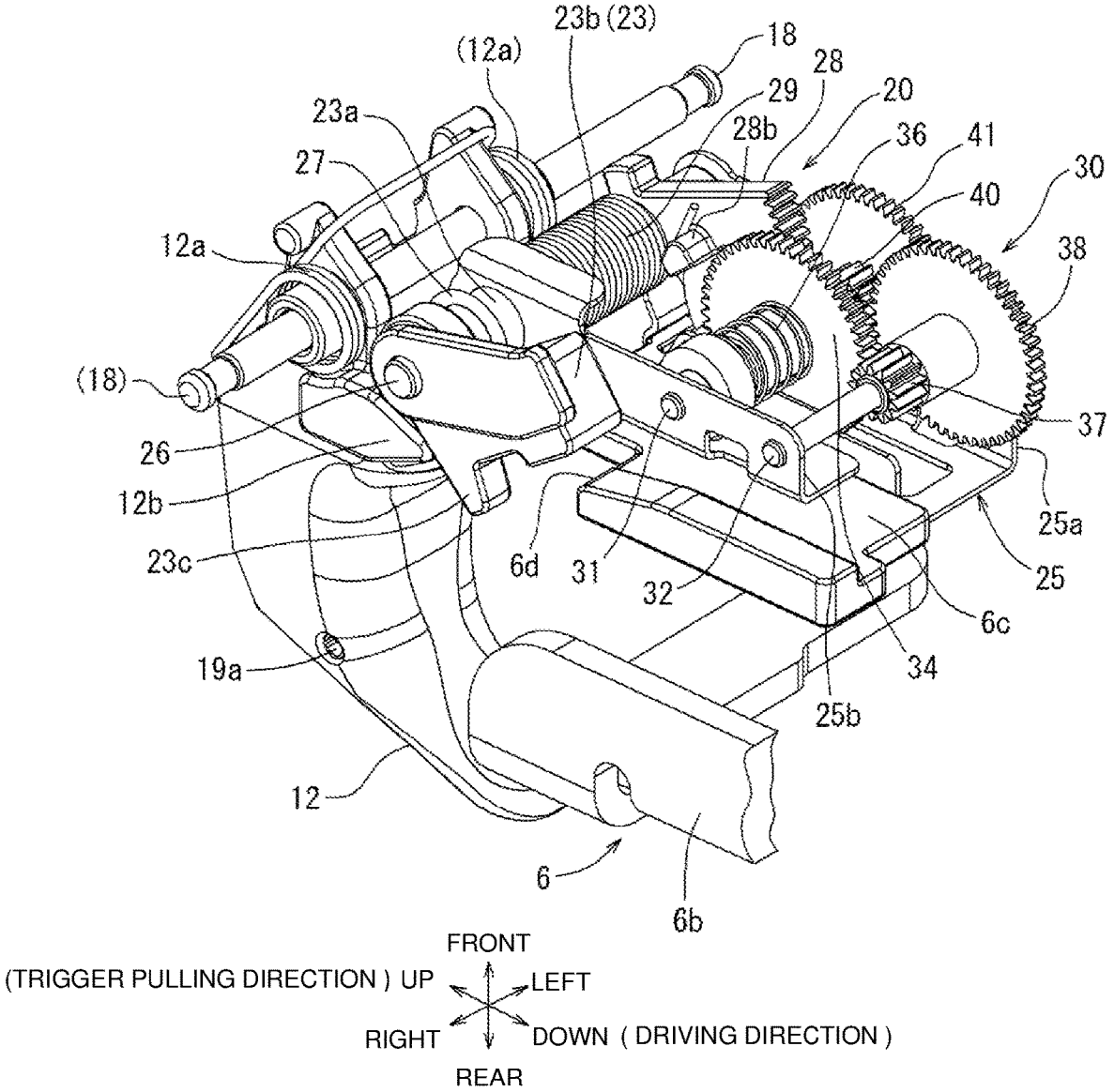
FIG. 16 is a perspective view of the timer assembly as viewed diagonally from the lower right with the activating system in its initial state with the trigger turned off and the contact arm turned off.

As shown in FIG. 16, the actuating member 6*c* in the contact arm 6 includes a stepped locking member 6*d*. The locking member 6*d* is engaged with the contact restrictor 23 (described later). With the contact restrictor 23 located above the locking member 6*d*, the contact arm 6 is restricted from being turned on and thus any driving operation is not allowed.

The timer assembly 20 is located below the trigger 12. The timer assembly 20 defines a predetermined period. The actuating member 6*c* in the contact arm 6 is vertically movable along the right side surface of the activating base 17. The timer assembly 20 is located below the trigger 12.

The timer assembly 20 includes the contact restrictor 23 and a multi-stage gear train 30. The gear train 30 is accommodated in an assembly case 21. The assembly case 21 is integral with the front surface of the activating base 17. The contact restrictor 23 is located outside the assembly case 21. The assembly case 21 is a rectangular box with an open front. The front opening of the assembly case 21 is covered with a lid 24. The lid 24 is connected to the assembly case 21 with a single fixing screw 24*a*. This structure protects the components inside from dust.

Figure 6:
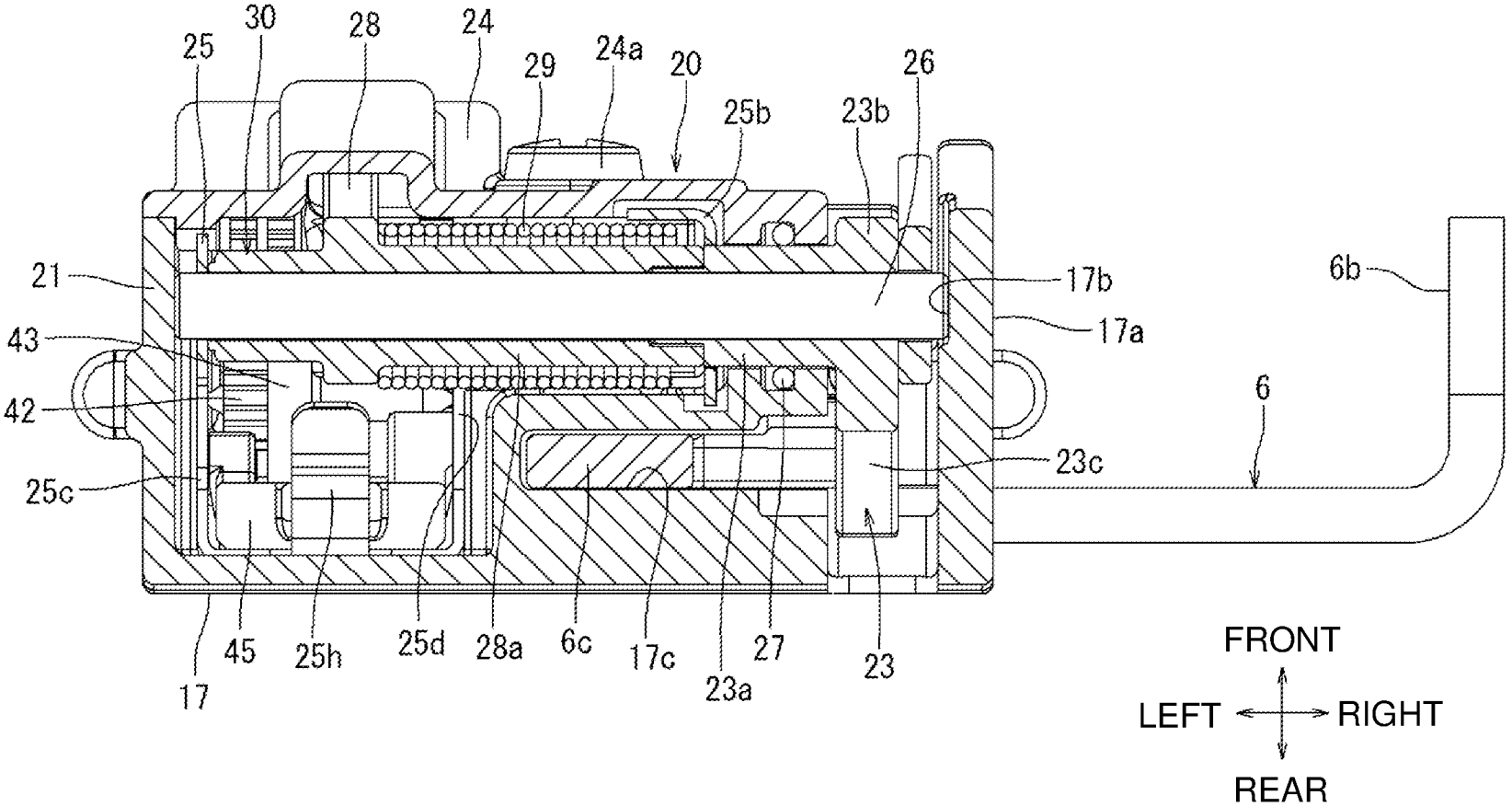
FIG. 6 is a cross-sectional view taken along line VI-VI in FIG. 5, as viewed in the direction indicated by arrows.

As shown in FIGS. 6 and 7, the contact restrictor 23 and the gear train 30 are assembled on a gear train base 25. In this state, the contact restrictor 23 and the gear train 30 are accommodated in the assembly case 21. The gear train base 25 is a steel plate processed by, for example, punching and bending. The contact restrictor 23 is located rightward from the gear train base 25, and is supported in a manner rotatable in the front-rear direction about a support shaft 26.

The support shaft 26 has its left end held in a left side wall 25*a* of the gear train base 25. The support shaft 26 has its right end held in a holding recess 17*b* on the shielding wall 17*a* of the activating base 17. The holding recess 17*b* is open frontward. The holding recess 17*b* receives the right end of the support shaft 26 placed from the front. This allows the contact restrictor 23 and the gear train 30 to be easily mounted on the activating base 17. The contact restrictor 23, the gear train 30, and a flywheel 43 are assembled on the single gear train base 25. The gear train base 25 is then mounted on the activating base 17. This structure can include the timer assembly 20 in the present embodiment without specifically changing the tool body 2.

The contact restrictor 23 includes a cylindrical support 23*a* and a restrictor 23*b*. The restrictor 23*b* protrudes from the right end of the support 23*a* in the radial direction. The support 23*a* passes through the right wall of the assembly case 21 to protrude outside. The restrictor 23*b* is integral with the protruding end of the support 23*a*. A seal member 27 is located between the support 23*a* and a right side wall 21*a* of the assembly case 21. This structure hermetically seals (prevents dust from entering) the assembly case 21 at the support of the contact restrictor 23.

The support shaft 26 supports a first gear 28 on its left portion. The first gear 28 is integral with a cylindrical support 28*a*. The first gear 28 is supported in a manner rotatable in the front-rear direction with the support 28*a* in between. A torsion spring 29 is placed around the support 28*a*. As shown in FIGS. 8 and 16 to 18, the torsion spring 29 has one end engaged with a spring engaging portion 28*b* in the first gear 28. Although not shown, the torsion spring 29 has the other end hooked on the gear train base 25. The torsion spring 29 thus urges the first gear 28 in the direction in which the first gear 28 rotates rearward.

The support 28*a* in the first gear 28 and the support 23*a* in the contact restrictor 23 rotate together. Thus, the torsion spring 29 urges both the first gear 28 and the contact restrictor 23 in the direction in which the first gear 28 and the contact restrictor 23 rotate rearward (to a contact lock position). The torsion spring 29 urges the contact restrictor 23 to the lock position. The contact restrictor 23 at the lock position restricts the actuating member 6*c* in the contact arm 6 from moving to the on-position.

Figure 17:
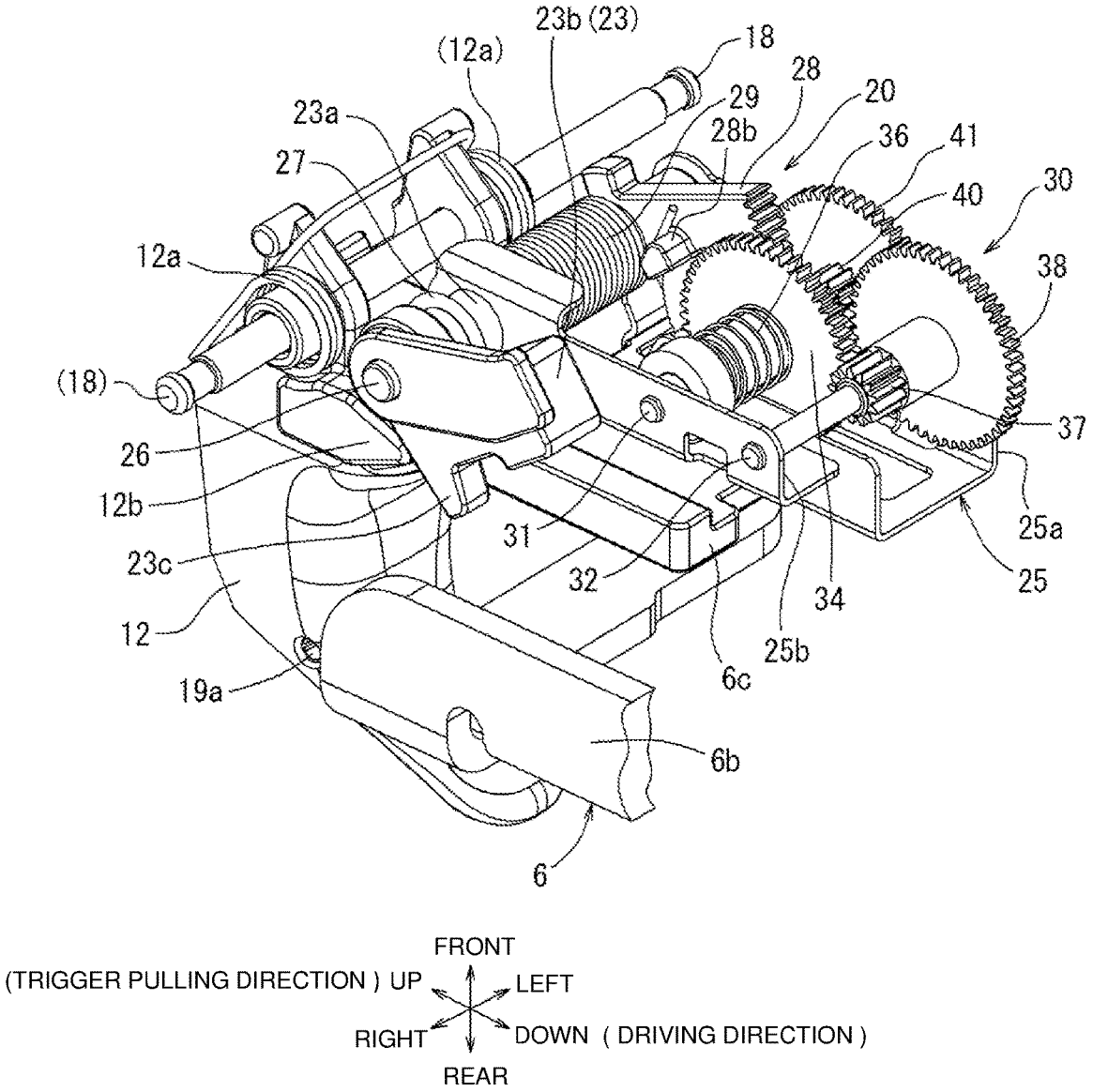

As shown in FIGS. 16 and 17, a derestrictor 12*b* is integral with the trigger 12 at its front (nearer the rotatably supported portion). With the trigger 12 being downward at the off-position under the urging force from the torsion spring 12*a*, the derestrictor 12*b* is engaged with a derestriction receiver 23*c* in the contact restrictor 23. This retains the contact restrictor 23 frontward at the unlock position (pressed upward in FIGS. 16 and 17) against the torsion spring 29. With the contact restrictor 23 at the unlock position, the contact arm 6 is allowed to move to the arm-on-position (on-operation).

Figure 19:
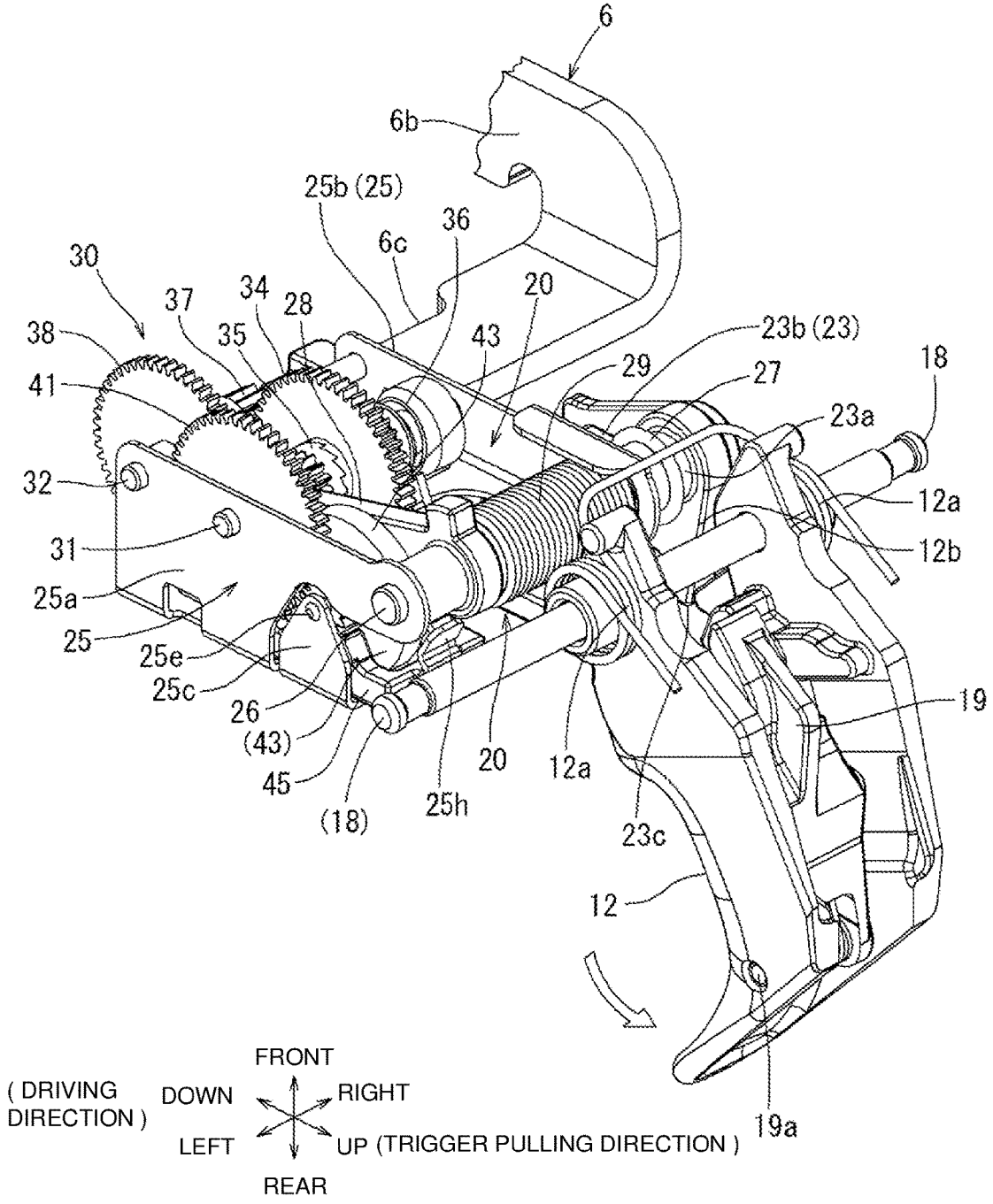

In contrast, as shown in FIG. 19, when the trigger 12 is pulled upward to the trigger-on-position as indicated by the solid-white arrow in the figure (on-operation), the derestrictor 12*b* retracts upward. This causes the urging force from the torsion spring 29 to rotate the contact restrictor 23 rearward (toward the lock position) as indicated by the solid-white arrow in FIG. 20. In response to the contact restrictor 23 reaching the lock position, the contact arm 6 is restricted from moving to the arm-on-position. The predetermined period t from an on-operation on the trigger 12 to when the contact restrictor 23 reaches the lock position is defined by the timer assembly 20 described below.

Figure 8:
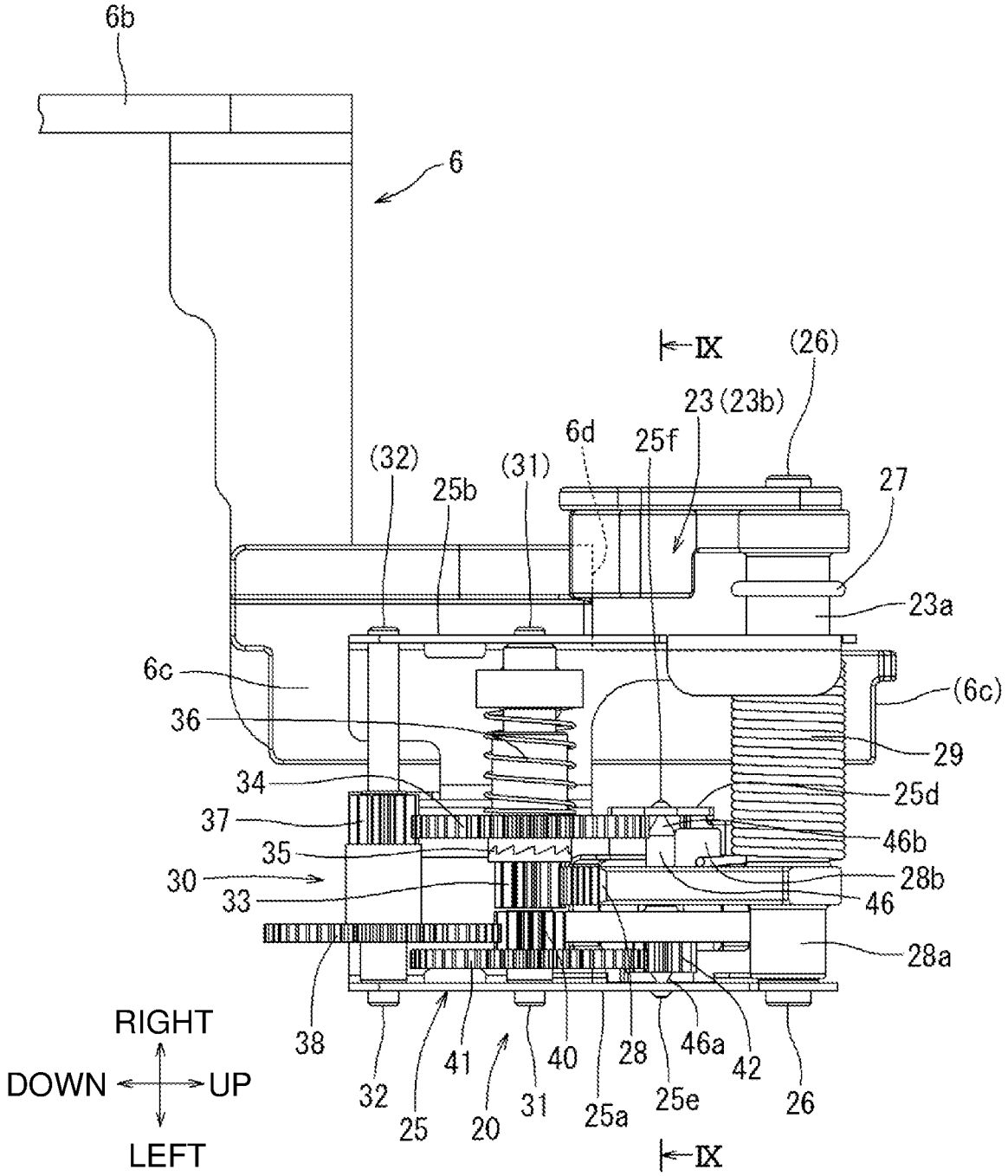
FIG. 8 is a front view of the timer assembly.
Figure 10:
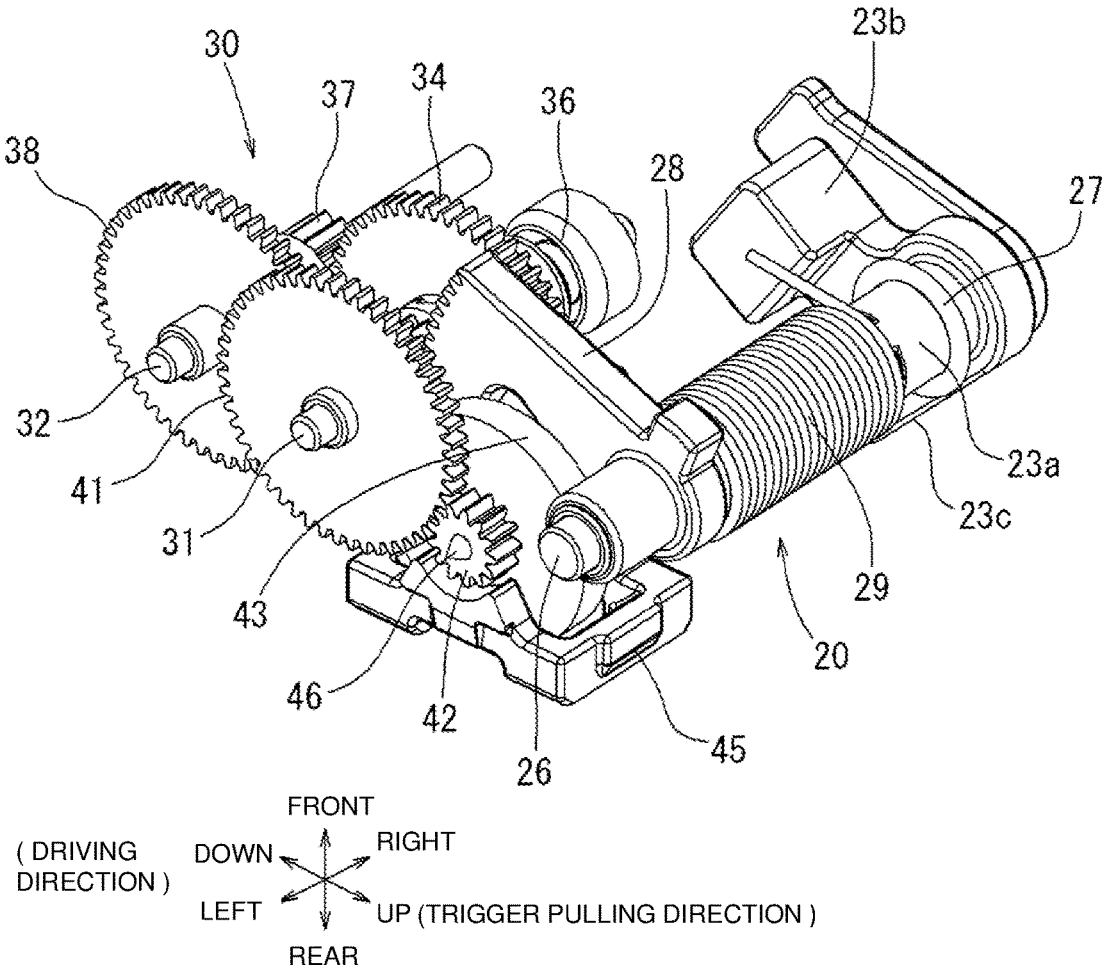
FIG. 10 is a perspective view of the timer assembly with a contact restrictor in its initial state being at an unlock position.
Figure 15:
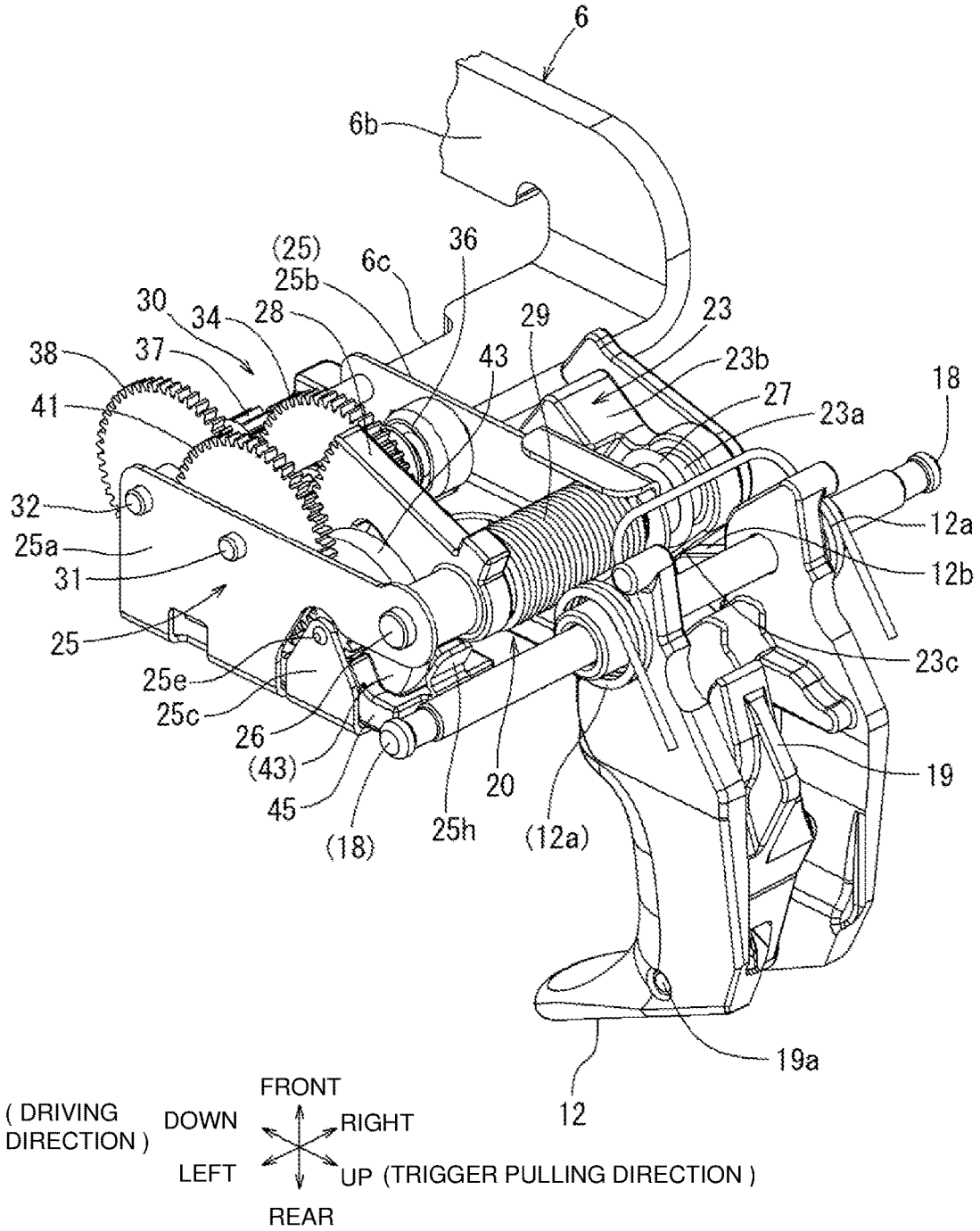
FIG. 15 is a perspective view of the timer assembly as viewed diagonally from the upper left with an activating system in its initial state with a trigger turned off and a contact arm turned off.

As shown in FIGS. 8, 10, and 15, the contact restrictor 23 is connected to the multi-stage gear train 30 via the first gear 28 in between. The rotational speed of the first gear 28 is increased by the gear train 30 and is then transmitted to the flywheel 43. The rotational speed of the flywheel 43 is thus increased. A first train shaft 31 and a second train shaft 32 extend across the left side wall 25*a* and a right side wall 25*b* of the gear train base 25. The first train shaft 31 and the second train shaft 32 are parallel to each other. The second train shaft 32 is located downward from the first train shaft 31.

A second gear 33 is rotatably supported on a substantially middle portion of the first train shaft 31. The second gear 33 meshes with the first gear 28. The second gear 33 is a spur gear having a smaller diameter than the first gear 28.

A third gear 34 is located rightward from the second gear 33, and is coaxial with the second gear 33. The second gear 33 and the third gear 34 are supported in a manner rotatable independently of each other. A positive clutch assembly 35 is located between the second gear 33 and the third gear 34. The clutch assembly 35 is a one-way clutch. With the clutch assembly 35 interlocked, the second gear 33 and the third gear 34 rotate together. The clutch assembly 35 is urged by a compression spring 36 and is interlocked. In response to the clutch assembly 35 disengaged against the compression spring 36, the power transmission path between the second gear 33 and the third gear 34 is disconnected. The contact restrictor 23 can thus quickly rotate toward the unlock position with no inertial force from the gear train 30 and the flywheel 43. The trigger 12 thus quickly returns to the off-position.

The third gear 34 is a spur gear having a larger diameter than the second gear 33. The third gear 34 meshes with a fourth gear 37. The fourth gear 37 is a spur gear having a smaller diameter than the third gear 34. The fourth gear 37 is rotatably supported on the second train shaft 32. A fifth gear 38 is located leftward from the fourth gear 37, and is supported rotatably. The fourth gear 37 and the fifth gear 38 integrally rotate together. The fifth gear 38 meshes with a sixth gear 40. The sixth gear 40 is a spur gear having a smaller diameter than the fifth gear 38.

The sixth gear 40 is rotatably supported on the first train shaft 31. The sixth gear 40 rotates separately from the second gear 33 and the third gear 34. A seventh gear 41 is integral with the sixth gear 40. The sixth gear 40 and the seventh gear 41 rotate together. The seventh gear 41 is a spur gear having a larger diameter than the sixth gear 40 and substantially the same diameter as the third gear 34 and the fifth gear 38.

The seventh gear 41 meshes with an eighth gear 42. The eighth gear 42 is a spur gear having a smaller diameter than the seventh gear 41 and substantially the same diameter as the second gear 33, the fourth gear 37, and the sixth gear 40.

Figure 12:
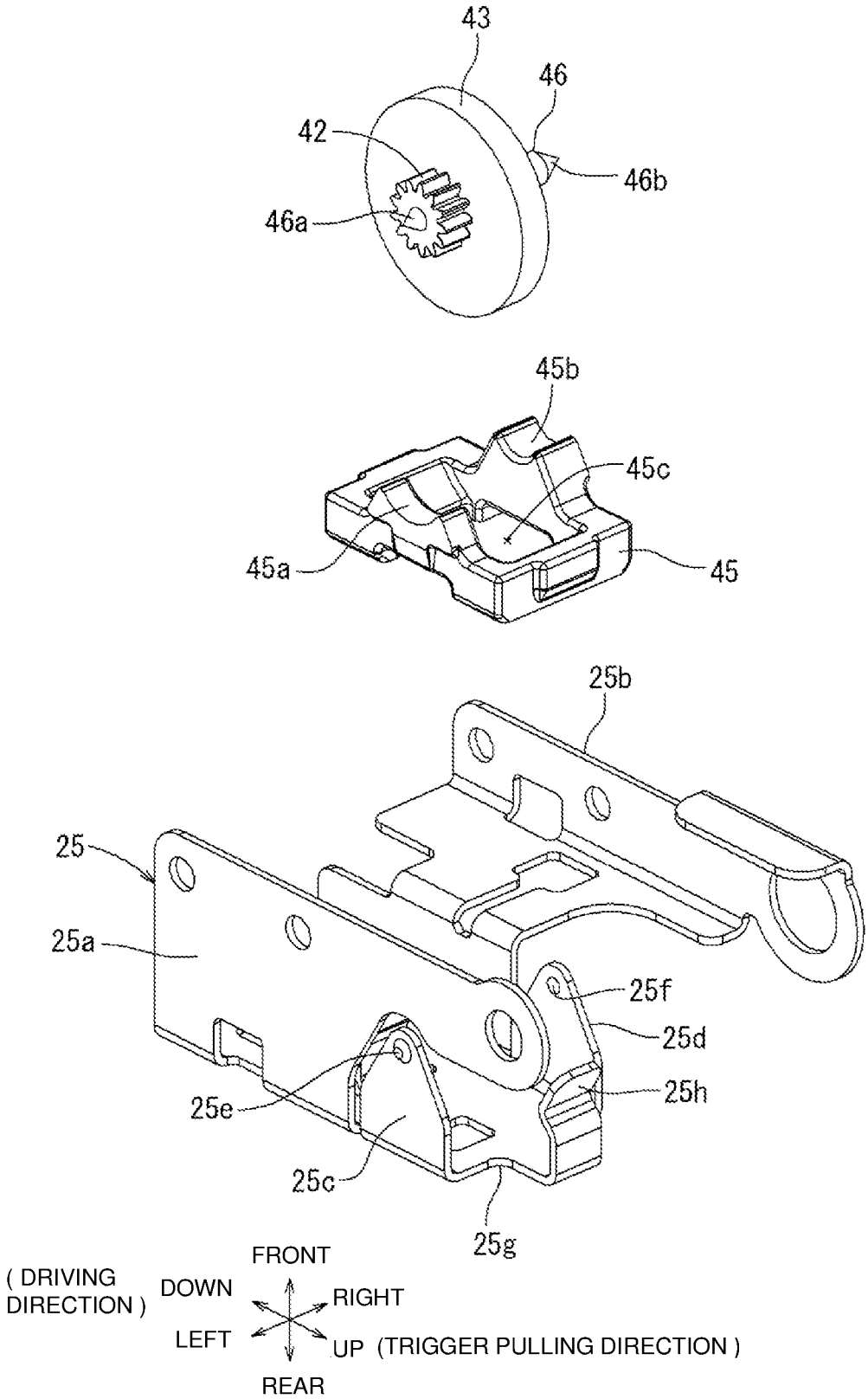
FIG. 12 is a perspective view of the gear train base with a flywheel and a distance retainer detached from the gear train base.

As shown in FIG. 12, the eighth gear 42 is integral with a support shaft 46. The flywheel 43 is integral with the support shaft 46, and is parallel to the eighth gear 42. The eighth gear 42 and the flywheel 43 rotate together with the support shaft 46.

Figure 9:
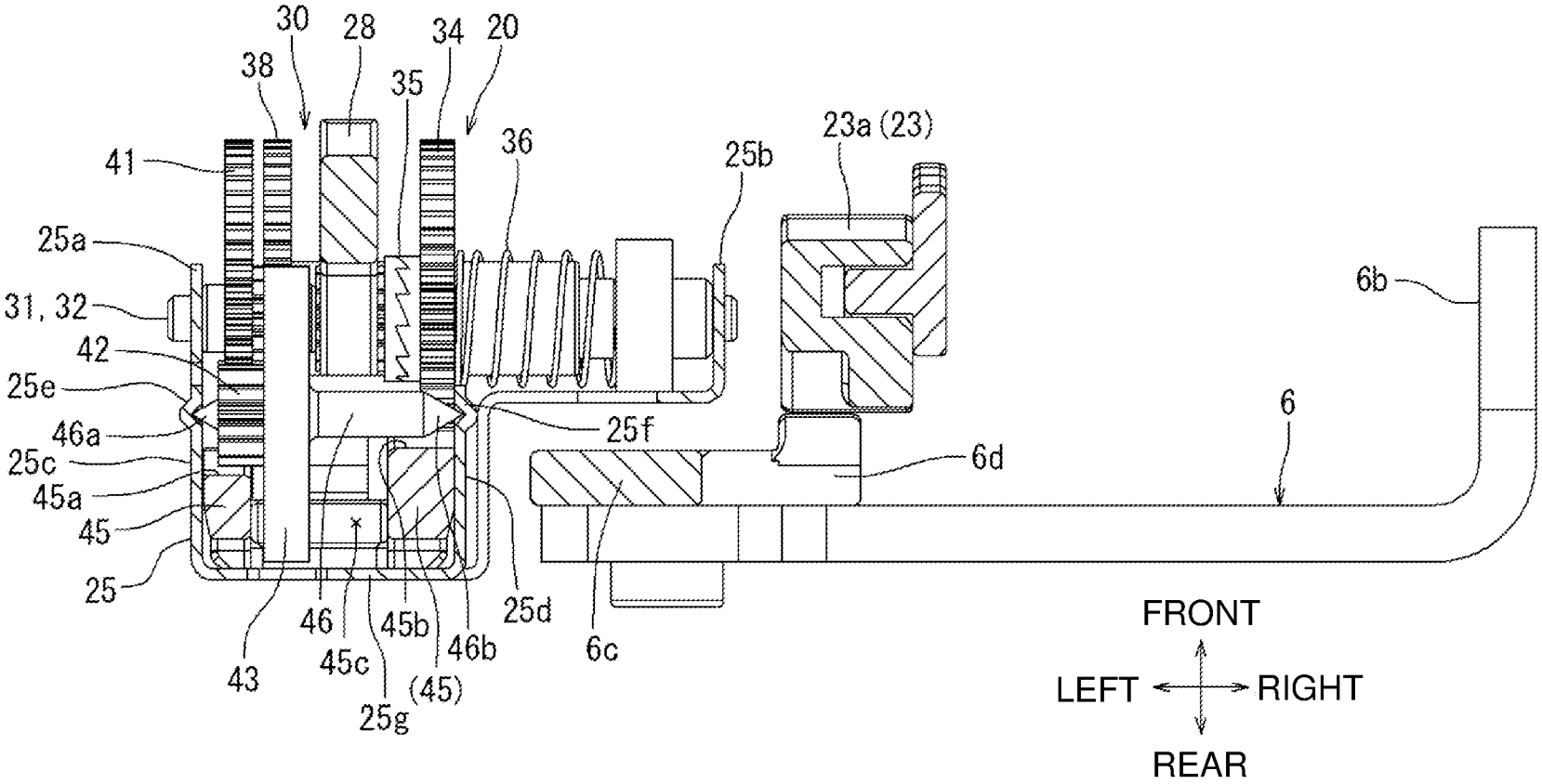
FIG. 9 is a cross-sectional view taken along line IX-IX in FIG. 8, as viewed in the direction indicated by arrows.
Figure 11:
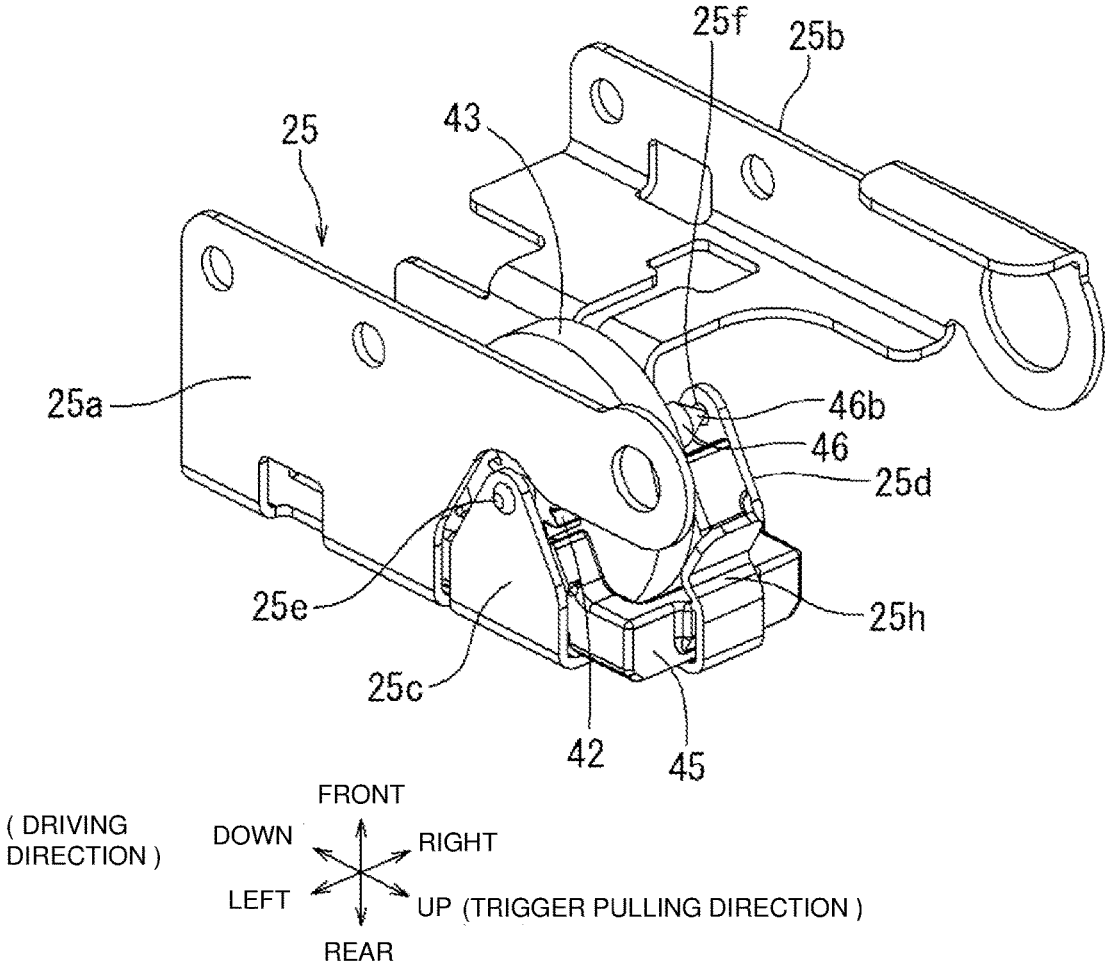
FIG. 11 is a perspective view of a gear train base.

As shown in FIGS. 9, 11, and 12, the support shaft 46 is supported across a first support wall 25*c* and a second support wall 25*d*. The first support wall 25*c* is located on an upper left portion of the gear train base 25. The second support wall 25*d* is located on an upper right portion of the gear train base 25. The first support wall 25*c* and the second support wall 25*d* are cut portions of the gear train base 25 that are substantially triangular. The first support wall 25*c* on the left is substantially flush with the left side wall 25*a* of the gear train base 25. The second support wall 25*d* on the right is much nearer the left side wall 25*a* than the right side wall 25*b* in the gear train base 25. The first support wall 25*c* and the second support wall 25*d* are connected at their rear portions with a joint 25*g*. The joint 25*g* is elastic and allows the first support wall 25*c* and the second support wall 25*d* to elastically move nearer or away from each other. The first support wall 25*c*, the second support wall 25*d*, and the joint 25*g* form a support for rotatably supporting the flywheel 43.

The first support wall 25*c* has a hemispherical holding recess 25*e* on its front portion. The second support wall 25*d* has a hemispherical holding recess 25*f* on its front portion. The left and right holding recesses 25*e* and 25*f* are recessed in opposing directions. The support shaft 46 has a first end 46*a* on its left and a second end 46*b* on its right. The first end 46*a* and the second end 46*b* each have a conical shape having a diameter gradually decreasing toward its pointed distal end. The first end 46*a* elastically abuts against the holding recess 25*e* and is thus held in the holding recess 25*e*. The second end 46*b* elastically abuts against the holding recess 25*f* and is thus held in the holding recess 25*f*. This holding structure with the conical shaft greatly reduces the rotational resistance of the support shaft 46.

A distance retainer 45 is received between the first support wall 25*c* and the second support wall 25*d*. The distance retainer 45 is fixed along the joint 25*g*. The distance retainer 45 restricts the distance between the first support wall 25*c* and the second support wall 25*d* to a predetermined distance to prevent the distance from being too small under an elastic force. As shown in FIG. 12, the distance retainer 45 has, on its front surface, a gear interference avoidance recess 45*a* and a shaft interference avoidance recess 45*b*. The gear interference avoidance recess 45*a* is semicircular and prevents interference with the eighth gear 42. The shaft interference avoidance recess 45*b* is semicircular and prevents interference with the support shaft 46. The distance retainer 45 may be changed. For example, a distance retainer may be attached to the outer surface of each of the first support wall 25*c* and the second support wall 25*d*. This structure restricts the distance between the first support wall 25*c* and the second support wall 25*d* to a predetermined distance to prevent the distance from being too large under an elastic force.

A wheel interference avoidance opening 45*c* is located between the gear interference avoidance recess 45*a* and the shaft interference avoidance recess 45*b*. The wheel interference avoidance opening 45*c* prevents interference with the flywheel 43. The distance retainer 45, at a portion near the support shaft 46, more reliably maintains the distance between the first support wall 25*c* and the second support wall 25*d* to prevent the distance from becoming smaller than appropriate. This structure reduces the rotational resistance of the support shaft 46 more reliably. The joint 25*g* has, on its upper portion, a stopper tab 25*h*, which is a cut and raised portion. The stopper tab 25*h* prevents the distance retainer 45 from being displaced and slipping off between the first support wall 25*c* and the second support wall 25*d*.

The holding structure with the conical shaft greatly reduces the rotational resistance of the flywheel 43. The flywheel 43 can thus rotate at higher speed. The gear train 30 increases the rotational speed of the flywheel 43 in four stages to greatly increase the rotational speed. This reduces the diameter of the flywheel 43 and allows the flywheel 43 to generate a larger inertial force by its rotation. The inertial force of the flywheel 43 applies a resistance against the movement of the contact restrictor 23 to the lock position. The predetermined period t is thus appropriately defined. The flywheel 43 having a smaller diameter allows the timer assembly 20 to be more compact.

In the present embodiment, the predetermined period t taken by the contact restrictor 23 to move from the unlock position to the lock position is set to about 3 to 5 seconds. The predetermined period t may be increased or decreased as appropriate by changing the inertial force of the flywheel 43 by, for example, changing the speed increasing ratio of the gear train 30.

In this manner, the inertial force of the flywheel 43 applies a resistance to the movement of the contact restrictor 23 to the lock position to set the predetermined period t for the contact restrictor 23 to rotate from the unlock position to the lock position. The timer assembly 20 with this structure located between the trigger 12 and the actuating member 6*c* in the contact arm 6 prevents an accidental driving operation when the trigger 12 is on.

In response to the trigger 12 and the contact arm 6 turned on, the idler 19 presses the valve stem 11*a* upward to turn on the activating valve 11. This causes compressed air to be fed into the piston upper chamber 16, thus causing a driving operation. In a continuous driving mode in which the trigger 12 is first turned on and then the contact arm 6 is turned on, the contact arm 6 is prevented from being turned on after the predetermined period t set by the timer assembly 20 passes from an on-operation on the trigger 12. The trigger 12 is released from the on-state to reset the state in which the contact arm 6 is prevented from being turned on. In the single driving mode in which the contact arm 6 is first turned on and then the trigger 12 is turned on, the timer assembly 20 has no time restriction. The operation of the timer assembly 20 for each driving operation mode will now be described.

In FIGS. 15 and 16, the trigger 12 is turned off and the contact arm 6 is turned off (initial state). In the initial state, as shown in FIG. 16, the derestrictor 12*b* in the trigger 12 presses the derestriction receiver 23*c* frontward. The contact restrictor 23 thus remains pressed upward toward the unlock position at the front.

In response to the contact arm 6 first moving upward from the initial state to the state shown in FIG. 17, the actuating member 6*c* passes behind the restrictor 23*b* in the contact restrictor 23 to reach the on-position. This allows an on-operation on the contact arm 6. The actuating member 6*c* thus presses the rotation distal end of the idler 19 upward. Subsequently turning on the trigger 12 turns on the activating valve 11. This causes a single driving operation.

Figure 18:
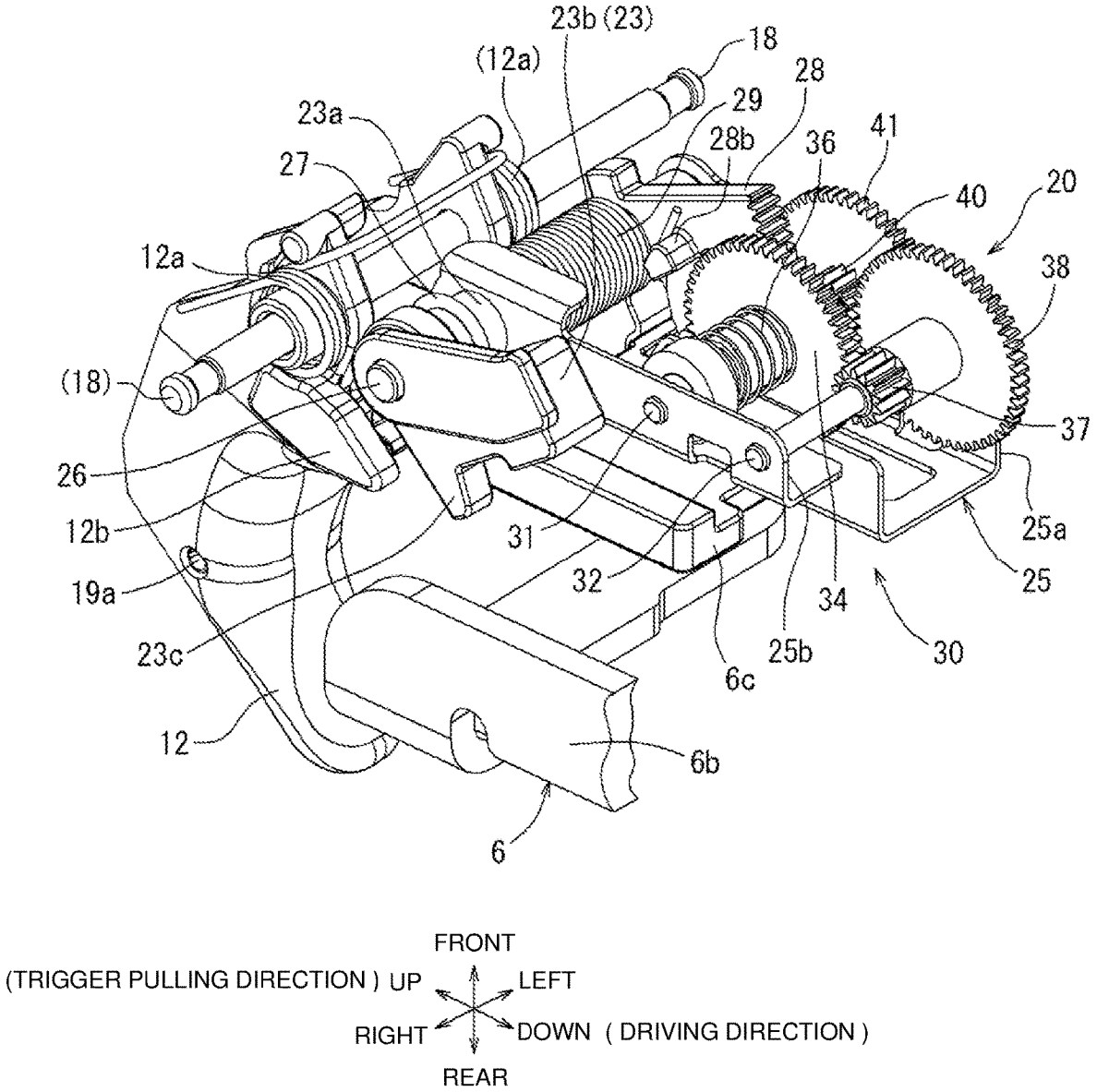
Figure 20:
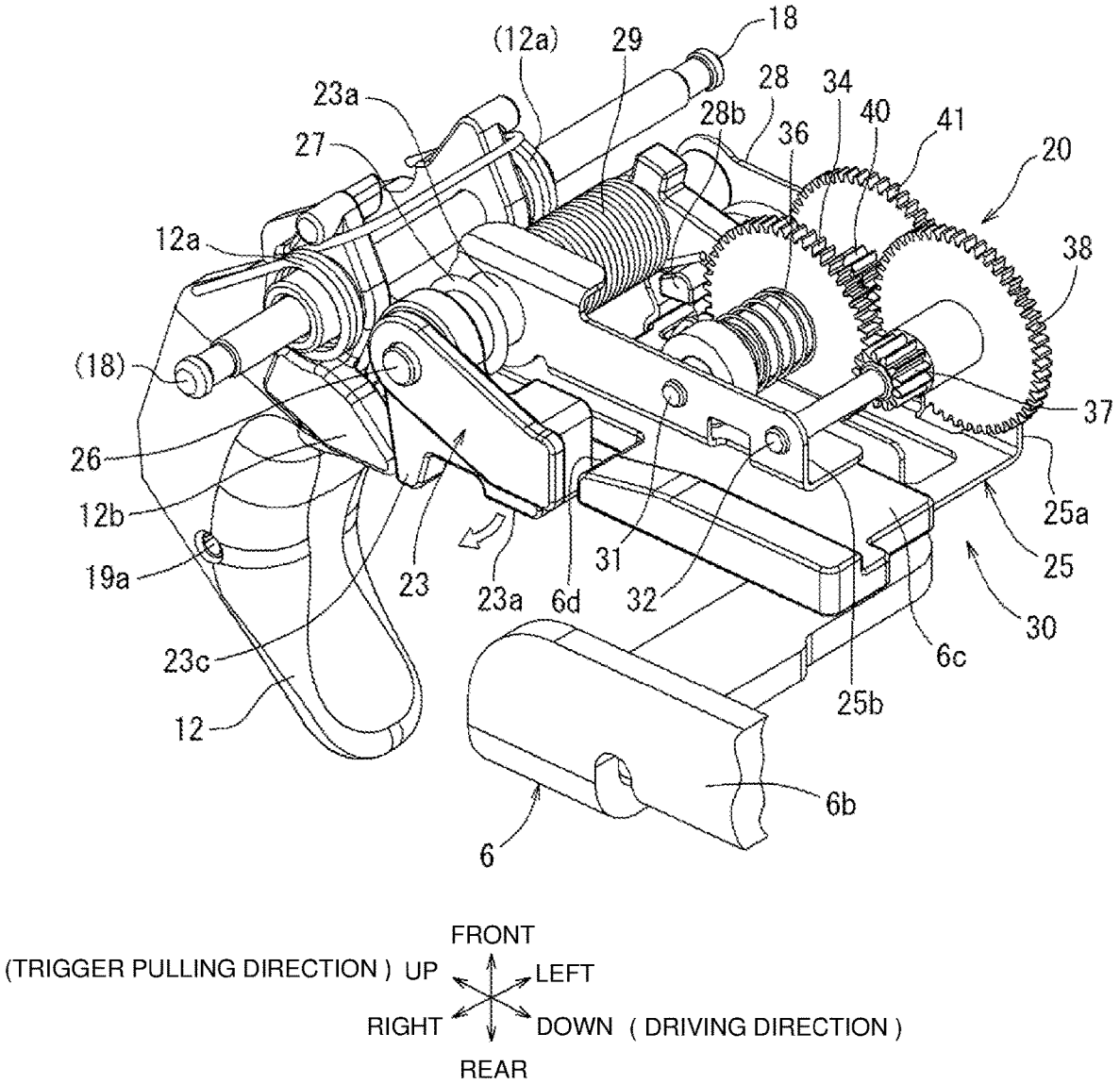

To perform continuous driving operations, the trigger 12 first moves upward and is turned on from the initial state shown in FIGS. 15 and 16 to the state shown in FIGS. 18 to 20. This activates the timer assembly 20. In response to the trigger 12 moving upward and is turned on, the derestrictor 12*b* moves upward. The derestriction receiver 23*c* is thus movable upward. The torsion spring 29 thus starts to rotate the contact restrictor 23 toward the lock position (rearward in FIGS. 18 to 20). In response to the contact restrictor 23 rotated toward the lock position, the restrictor 23*b* moves rearward (toward the lock position). The restrictor 23*b* thus enters the guide groove 17*c* in the activating base 17.

As shown in FIG. 18, when the contact arm 6 is turned on before the predetermined period t passes from an on-operation on the trigger 12, the restrictor 23*b* in the contact restrictor 23 is yet to reach the lock position. The actuating member 6*c* thus passes upward inside the guide groove 17*c*. This turns on the contact arm 6. The trigger 12 is turned on and then the contact arm 6 is turned on to turn on the activating valve 11, thus causing a driving operation.

When the contact arm 6 is not turned on before the predetermined period t passes from an on-operation on the trigger 12, the contact arm 6 enters a locked state in which the restrictor 23*b* in the contact restrictor 23 is inside the guide groove 17*c* as shown in FIGS. 19 and 20. In the locked state, the locking member 6*d* in the actuating member 6*c* is in contact with the restrictor 23*b*, restricting the actuating member 6*c* from moving further upward. In the locked state, the contact arm 6 is restricted from being turned on. The activating valve 11 is thus restricted from being turned on. This causes no driving operation with the tool body 2. The trigger 12 is released from the on-state to reset the locked state of the contact arm 6.

When the contact arm 6 is turned off with the trigger 12 remaining turned on after one single driving operation, the contact restrictor 23 is rotatable toward the lock position. With the trigger 12 remaining turned on, the derestrictor 12*b* is upwardly away from the derestriction receiver 23*c*. Thus, the contact arm 6 returns to the off-position after one single driving operation to activate the timer assembly 20. The contact arm 6 is subsequently turned on again before the predetermined period t passes to allow continuous driving operations. After the predetermined period t, the contact arm 6 is prevented from being turned on. This prevents an accidental driving operation. The timer assembly 20 is activated when the trigger 12 is turned on and the contact arm 6 is turned off.

As shown in FIGS. 13 and 14, the shielding wall 17*a* in the activating base 17 has a circular window 17*d*. As shown in FIG. 14, the restrictor 23*b* in the contact restrictor 23 reaches the lock position when the predetermined period t passes. The restrictor 23*b* in this state covers the window 17*d*. This allows the user to visually observe the restrictor 23*b* through the window 17*d*. The user can thus determine that the contact arm 6 is locked. The user can also determine by visual observation that the contact restrictor 23 operates normally. As shown in FIG. 13, with the contact restrictor 23 at the unlock position, the restrictor 23*b* does not cover the window 17*d*. The user can thus determine that the contact arm 6 is unlocked.

The driving tool 1 according to the present embodiment does not allow, in the continuous driving mode in which the trigger 12 is first turned on, an on-operation on the contact arm 6 after the predetermined period t from an on-operation on the trigger 12. This reliably prevents an accidental driving operation of the driving tool 1 that is being carried with the trigger 12 accidentally remaining pulled.

The timer assembly 20 in the present embodiment uses the inertial force of the flywheel 43 to set the predetermined period t. This eliminates a moving part that is powered by, for example, compressed air, and thus allows a smooth operation of the timer assembly 20. This structure is unsusceptible to heat around a rotary damper containing, for example, a silicone oil that is used to set a time corresponding to the predetermined period t, and allows control of driving operations in a constant and stable manner for the predetermined period t.

The timer assembly 20 in the present embodiment includes the flywheel 43 including the support shaft 46 having the first end 46*a* and the second end 46*b* each having a diameter gradually decreasing toward its distal end. The support shaft 46 has the first end 46*a* held in the holding recess 25*e* on the first support wall 25*c* and the second end 46*b* held in the holding recess 25*f* on the second support wall 25*d*. This structure greatly reduces the rotational resistance of the flywheel 43 with respect to the first support wall 25*c* and the second support wall 25*d*. The flywheel 43 thus generates a larger inertial force.

The timer assembly 20 in the present embodiment includes the first support wall 25*c* rotatably supporting the first end 46*a* of the support shaft 46 and the second support wall 25*d* rotatably supporting the second end 46*b* of the support shaft 46. The first support wall 25*c* and the second support wall 25*d* are elastically connected with the joint 25*g* between them. The joint 25*g* is elastic and allows the first support wall 25*c* to be elastically in contact with the first end 46*a* and the second support wall 25*d* to be elastically in contact with the second end 46*b*. This structure reduces the rotational resistance of the first end 46*a* and the second end 46*b* of the support shaft 46 with respect to the first support wall 25*c* and the second support wall 25*d*. This stabilizes the rotation of the flywheel 43, allowing stable measurement of the predetermined period t taken for the contact restrictor 23 to move from the unlock position to the lock position.

The timer assembly 20 includes the multi-stage gear train 30 of gears that rotate under the urging force from the torsion spring 29 in response to the trigger 12 moving to the on-position (trigger-on-position). The gear train 30 increases the rotational speed of the flywheel 43. This reduces the diameter of the flywheel 43 and allows the flywheel 43 to generate a larger inertial force by its rotation.

The timer assembly 20 in the present embodiment includes the assembly case 21 hermetically enclosing the flywheel 43 and the gear train 30. The seal member 27 hermetically seals a portion between the assembly case 21 and the support 23*a* in the contact restrictor 23 extending from the assembly case 21. This structure protects the flywheel 43 and the gear train (timer assembly 20) from dust (foreign matter). The predetermined period t is thus stabilized.

The gear train 30 includes a first-stage speed-increasing part (meshing portion between the first gear 28 and the second gear 33) and a third-stage speed-increasing part (meshing portion between the fifth gear 38 and the sixth gear 40) that are coaxial with each other on the first train shaft 31. This allows the gear train 30 to be compact.

The gear train 30 includes the clutch assembly 35 on the power transmission path. The clutch assembly 35 closes the power transmission path of the gear train 30 to allow the trigger 12 to quickly return to the off-position with no operating resistance of the gear train 30 and no inertial force from the flywheel 43.

The clutch assembly 35 is a one-way clutch. This structure with the simple clutch assembly 35 allows the trigger 12 to quickly return to the off-position while appropriately maintaining the predetermined period t.

The timer assembly 20 in the present embodiment includes the gear train 30 supported on the single gear train base 25. This structure allows the four-stage gear train 30 and the flywheel 43 to be mounted on the gear train base 25 with stable accuracy. This stabilizes the rotation of the flywheel 43 to allow the predetermined period t to be highly accurate and stable.

The shielding wall 17*a* laterally shielding the contact restrictor 23 has the window 17*d* through which the contact restrictor 23 is visually observed laterally (from outside the activating system 10). The contact restrictor 23 is viewed through the window 17*d* for quick determination of the operating state of the timer assembly 20. The operating state of the contact restrictor 23 is visually observed through the window 17*d* also for indirectly determining whether the inside of the hermetically sealed assembly case 21 is protected from dust (no malfunctions are caused by, for example, foreign matter).

The embodiment described above may be modified variously. For example, the timer assembly 20 includes the gear train 30 that increases speed in four stages. The gear train 30 may be a gear train that increases speed in one to three stages or in five or more stages.

In the above example, the flywheel 43 has a support with the support shaft 46 having the first end 46*a* and the second end 46*b* each having a pointed conical shape. The flywheel 43 may be supported on the first support wall and the second support wall with bearings such as sliding bearings and rolling bearings in between.

In the above example, the driving tool 1 is a pneumatic nailer. In some embodiments, the driving tool may be, for example, an electric tacker including a contact arm used to prevent an accidental operation.

REFERENCE SIGNS LIST

W workpiece
T fastener
driving tool
tool body
2*a* head valve
2*b* compression spring
3 grip
3*a* accumulator
4 driving nose
5 magazine
6 contact arm
6*a* contact portion
6*b* extension
6*c* actuating member
6*d* locking member
7 trigger lock lever
8 base
10 activating system
11 activating valve
11*a* valve stem
11*b* compression spring
12 trigger
12*a* torsion spring
12*b* derestrictor
13 piston
14 impact driver
15 cylinder
15*a* return air chamber
15*b* air vent
16 piston upper chamber
17 activating base
17*a* shielding wall
17*b* holding recess
17*c* guide groove
17*d* window
18 support shaft
19 idler
19*a* support shaft
20 timer assembly
t predetermined period
21 assembly case
21*a* right side wall
23 contact restrictor
23*a* support
23*b* restrictor
23*c* derestriction receiver
24 lid
24*a* fixing screw
25 gear train base
25*a* left side wall
25*b* right side wall
25*c* first support wall (left side)
25*d* second support wall (right side)
25*e*, 25*f* holding recess
25*g* joint
25*h* stopper tab
26 support shaft
27 seal member
28 first gear
28*a* support
28*b* spring engaging portion
29 torsion spring
30 gear train
31 first train shaft
32 second train shaft
33 second gear
34 third gear
35 clutch assembly (one-way clutch)
36 compression spring
37 fourth gear
38 fifth gear
40 sixth gear
41 seventh gear
42 eighth gear
43 flywheel
45 distance retainer
45*a* gear interference avoidance recess
45*b* shaft interference avoidance recess
45*c* wheel interference avoidance opening
46 support shaft
46*a* first end
46*b* second end

What is claimed is:

1. A driving tool, comprising:

a trigger movable between a trigger-on-position and a trigger-off-position;

a contact arm movable between an arm-on-position and an arm-off-position; and a timer assembly configured to operate in response to the trigger moving to the trigger-on-position with the contact arm remaining at the arm-off-position, the timer assembly including a flywheel rotatable in response to the trigger moving to the trigger-on-position, and a contact restrictor movable between an unlock position at which the contact restrictor allows the contact arm to move to the arm-on-position and a lock position at which the contact restrictor restricts the contact arm from moving to the arm-on-position, the contact restrictor being configured to take a predetermined period to move from the unlock position to the lock position in response to the trigger moving to the trigger-on-position, the predetermined period being defined by an inertial force generated by rotation of the flywheel.

2. The driving tool according to claim 1, further comprising:

a support rotatably supporting the flywheel, wherein the flywheel includes a support shaft having two ends supported by the support, and at least one of the two ends of the support shaft has a conical shape having a diameter decreasing toward the support.

3. The driving tool according to claim 2, wherein the support includes a first support wall rotatably supporting a first end of the support shaft, a second support wall rotatably supporting a second end of the support shaft, and a joint elastically connecting the first support wall and the second support wall, the joint is elastic and allows the first support wall to be elastically in contact with the first end, and the joint is elastic and allows the second support wall to be elastically in contact with the second end.

4. The driving tool according to claim 3, wherein the timer assembly includes a multi-stage gear train configured to increase speed of a rotating motion caused by a force from the trigger moving to the trigger-on-position and transmit the rotating motion to the flywheel.

5. The driving tool according to claim 2, wherein the timer assembly includes a multi-stage gear train configured to increase speed of a rotating motion caused by a force from the trigger moving to the trigger-on-position and transmit the rotating motion to the flywheel.

6. The driving tool according to claim 1, wherein the timer assembly includes a multi-stage gear train configured to increase speed of a rotating motion caused by a force from the trigger moving to the trigger-on-position and transmit the rotating motion to the flywheel.

7. The driving tool according to claim 6, further comprising:

an assembly case hermetically enclosing the flywheel and the multi-stage gear train; and a seal member hermetically sealing a portion between the assembly case and a support in the contact restrictor extending from the assembly case.

8. The driving tool according to claim 7, wherein the assembly case includes a shielding wall laterally shielding the contact restrictor, and the shielding wall includes a window through which the contact restrictor is visually observed laterally.

9. The driving tool according to claim 6, further comprising:

a gear train base supporting the multi-stage gear train and being a single member.

10. The driving tool according to claim 6, further comprising:

a clutch assembly located on a power transmission path of the multi-stage gear train.

11. The driving tool according to claim 10, further comprising:

a gear train base supporting the multi-stage gear train and being a single member.

12. The driving tool according to claim 10, wherein the clutch assembly includes a one-way clutch.

13. The driving tool according to claim 12, further comprising:

a gear train base supporting the multi-stage gear train and being a single member.

14. The driving tool according to claim 6, wherein at least two gears in the multi-stage gear train are coaxial with each other.

15. The driving tool according to claim 14, further comprising:

a clutch assembly located on a power transmission path of the multi-stage gear train.

16. The driving tool according to claim 14, further comprising:

a gear train base supporting the multi-stage gear train and being a single member.

17. The driving tool according to claim 7, wherein at least two gears in the multi-stage gear train are coaxial with each other.

18. The driving tool according to claim 7, further comprising:

a clutch assembly located on a power transmission path of the multi-stage gear train.

19. The driving tool according to claim 7, further comprising:

a gear train base supporting the multi-stage gear train and being a single member.

* * * * *